US008500476B2

(12) United States Patent
Hori et al.

(10) Patent No.: US 8,500,476 B2
(45) Date of Patent: Aug. 6, 2013

(54) POWER-FEED CONNECTOR

(75) Inventors: Yasunobu Hori, Sakura (JP); Keiji Yahagi, Tokyo (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 13/326,089

(22) Filed: Dec. 14, 2011

(65) Prior Publication Data

US 2012/0088384 A1 Apr. 12, 2012

Related U.S. Application Data

(63) Continuation of application No. PCT/JP2010/073512, filed on Dec. 27, 2010.

(30) Foreign Application Priority Data

Dec. 28, 2009 (JP) ..... 2009-296621
Dec. 28, 2009 (JP) ..... 2009-296622
Dec. 28, 2009 (JP) ..... 2009-296625

(51) Int. Cl.
*H01R 13/62* (2006.01)

(52) U.S. Cl.
USPC ..... 439/310; 439/34

(58) Field of Classification Search
USPC ..... 439/34, 157, 159, 160, 310, 352, 439/357; 320/107
See application file for complete search history.

(56) References Cited

U.S. PATENT DOCUMENTS 3,529,276 A 9/1970 Hennessey, Jr.
5,417,579 A * 5/1995 Yoshioka et al. ..... 439/310
5,429,524 A 7/1995 Wakata et al.
5,575,675 A * 11/1996 Endo et al. ..... 439/310
5,676,560 A 10/1997 Endo et al.
5,873,737 A * 2/1999 Hashizawa et al. ..... 439/39
6,652,306 B2 * 11/2003 Karamatsu et al. ..... 439/310

(Continued)

FOREIGN PATENT DOCUMENTS

EP 0646995 A2 4/1995
JP 5223442 A 2/1977

(Continued)

OTHER PUBLICATIONS

Communication dated Jan. 17, 2012 from the Japanese Patent Office in counterpart Japanese application No. 2011-187772.

(Continued)

*Primary Examiner* — Thanh Tam Le
(74) *Attorney, Agent, or Firm* — Sughrue Mion, PLLC

(57) ABSTRACT

A power-feed connector comprises a tubular case that has a front end opening portion; a connector body that is housed in the tubular case and can slide along a center axis direction of the tubular case; and an operating mechanism that operates the sliding of the connector body along the center axis direction, wherein the operating mechanism at least comprises an operating lever that is pivotally supported at the tubular case rotatably and a first end of which protrudes outside of the tubular case, and a conversion mechanism that converts a rotating force of the operating lever generated by moving the first end only into a force in the center axis direction of the tubular case; and a moving direction of the first end of the operating lever is coincident with a moving direction of the connector body which moves in association with the rotation of the operating lever.

9 Claims, 9 Drawing Sheets

U.S. PATENT DOCUMENTS

| | | | | |
|---|---|---|---|---|
| 8,016,607 | B2 * | 9/2011 | Brown, II | 439/353 |
| 8,206,171 | B2 * | 6/2012 | Osawa et al. | 439/352 |
| 8,342,856 | B2 * | 1/2013 | Takada et al. | 439/34 |
| 8,376,767 | B2 * | 2/2013 | Kahara et al. | 439/304 |
| 2002/0177348 | A1 | 11/2002 | Karamatsu et al. | |

FOREIGN PATENT DOCUMENTS

| | | | |
|---|---|---|---|
| JP | 06-302355 | A | 10/1994 |
| JP | 07-065900 | A | 3/1995 |
| JP | 07-282902 | A | 10/1995 |
| JP | 09-223534 | A | 8/1997 |
| JP | 2752032 | B2 | 2/1998 |
| JP | 3055054 | U | 12/1998 |
| JP | 2002-352909 | A | 12/2002 |

OTHER PUBLICATIONS

International Search Report of PCT/JP2010/073512, dated Apr. 19, 2011.

Japanese Notice of Allowance of JP 2011-521394, dated Oct. 25, 2011.

Japanese Office Action of JP 2011-187772, dated Oct. 25, 2011.

European Search Report issued in European Application No. 10840980.6 dated Mar. 22, 2013.

* cited by examiner

POWER-FEED CONNECTOR

CROSS-REFERENCE TO RELATED APPLICATIONS

This application is a continuation application based on PCT Patent Application No. PCT/JP2010/073512, filed Dec. 27, 2010, the priorities of which are claimed on Japanese Patent Application No. 2009-296621, filed Dec. 28, 2009, Japanese Patent Application No. 2009-296622, filed Dec. 28, 2009, and Japanese Patent Application No. 2009-296625, filed Dec. 28, 2009, the entire contents of which are hereby incorporated by reference.

BACKGROUND OF THE INVENTION

1. Field of the Invention

The present invention relates to a power-feed connector used for charging an electric machine such as an electric vehicle.

2. Description of the Related Art

Conventionally, an electric machine, such as an electric vehicle which is driven by an electric power source, is charged by a power-feed connector. For example, a power-feed connector used for charging an electric machine is disclosed in Patent Document 1. The power-feed connector described in Patent Document 1 includes a tubular case, a connector body which is slidably mounted on an anterior half portion of the tubular case and has a plurality of terminals, and an operating lever for operating the movement of the connector body.

In the power-feed connector described in Patent Document 1, an intermediate portion of the operating lever is pivotally supported within the tubular case. A first end portion (function portion) of the operating lever is pivotally fitted in the connector body. A second portion (operation portion) of the operating lever protrudes outside the tubular case. In the power-feed connector, the operating lever moves backward against the tubular case, in order to move the connector body forward against the tubular case. Namely, the moving directions of the operating lever and the connector body are mutually reverse.

The power-feed connector disclosed in Patent Document 1 (Japanese Patent No. 2752032) includes a locking unit and an unlocking lever for releasing the lock of the locking unit, in which the connector body moves forward by rotating the operating lever, and the locking unit locks the operating lever in a fitting position where the power-receiving connector provided in the electric vehicle and the connector body are fitted. Namely, in the power-feed connector of the related art, the operating lever is operated while connecting (attaching) the power-feed connector to the power-receiving connector and the unlocking lever is operated while detaching the power-feed connector from the power-receiving connector.

The power-feed connector of the related art further includes an engaging unit (locking unit) for locking the tubular case to the power-receiving connector in a state in which the tubular case is plugged into the power-receiving connector, in order to ensure that the power-feed connector does not become detached from the power-receiving connector all of a sudden during charging.

The engaging unit includes a locking member (locking arm), an urging member (return spring), and a locking mechanism (a mechanism consisting of, for example, a driving boss of the power-receiving connector, a driven pin of the power-feed connector, a plate spring, and the like). The locking member is mounted on the tubular case, and can be movable between a locking position in which the locking member is locked with the power-receiving connector and a retracted position in which the locking member is not locked with the power-receiving connector. The urging member urges the locking member from the locking position toward the retracted position. The locking mechanism moves the locking member from the retracted position to the locking position resisting the urging force of the urging member, simultaneously with the plugging operation of the tubular case with respect to the power-receiving connector.

The locking state between the tubular case and the power-receiving connector by the engaging unit can be relieved by operating the unlocking lever in the same way as in the case of the locking unit.

However, in the power-feed connector disclosed in Patent Document 1, since the moving directions of the operating lever and the connector body are reverse, an operator cannot operate the operating lever intuitively, and cannot perform the charging operation smoothly. In other words, the intuitive operating feeling of the operator is undermined while attaching and detaching the power-feed connector with respect to the power-receiving connector.

In the power-feed connector disclosed in Patent Document 1, since the operating lever for connecting the power-feed connector to the power-receiving connector differs from the operating lever for detaching the power-feed connector from the power-receiving connector, confusion will be caused while operating the power-feed connector, and the charging operation cannot be performed smoothly.

A mechanism (locking mechanism) for moving the locking member to a locking position, a mechanism (operating lever) for moving the connector body forward and engaging it to the power-receiving connector, and a mechanism (unlocking lever) for releasing the engaging state of the connector body and the power-receiving connector and for releasing the locking state of the tubular case and the power-receiving connector are provided separately. Therefore, there is a problem in that the inner structure of the power-feed connector becomes complicated, and miniaturization and manufacturing cost reduction are limited.

SUMMARY

The present invention has been made in consideration of the above circumstances and has a first object to provide a power-feed connector which can provide an intuitive operating feeling, and can smoothly perform a charging operation.

The present invention has a second object to provide a power-feed connector, the inner structure of which can be simplified.

The present invention employs the following in order to solve the above-mentioned problems.

(1) A power-feed connector of one aspect of the present invention comprises a tubular case that has a front end opening portion; a connector body that is housed in the tubular case, and that can slide along a center axis direction of the tubular case; and an operating mechanism that operates the sliding of the connector body along the center axis direction, wherein the operating mechanism at least comprises an operating lever that is pivotally supported at the tubular case rotatably and a first end of which protrudes outside the tubular case, and a conversion mechanism that converts a rotating force of the operating lever generated by moving the first end only into a force in the center axis direction of the tubular case; and a moving direction of the first end of the operating lever is coincident with a moving direction of the connector body which moves in association with the rotation of the operating lever.

(2) The conversion mechanism may comprise a spur gear that is pivotally supported at the tubular case integrally with a second end of the operating lever, and a rack that is fixed at the connector body and moves along the center axis direction of the tubular case simultaneously with a rotation of the spur gear.

(3) An action point that applies the rotating force of the operating lever to the connector body may be positioned between the first end and the second end of the operating lever.

(4) The spur gear may comprise a first spur gear that is pivotally supported at the tubular case integrally with the second end of the operating lever; and a second spur gear that is pivotally supported at the tubular case and engages with the first spur gear and the rack.

(5) The conversion mechanism may comprise a first rack that is fixed at the connector body; a second rack that connects to a second end of the operating lever and faces the first rack, and the second rack slides along the center axis direction in association with a rotation of the operating lever; and a spur gear that is placed between the first rack and the second rack, and engages with the first rack and the second rack.

(6) The power-feed connector may further comprise an electromagnetic locking mechanism having a solenoid provided at the tubular case and a locking portion provided at the connector body.

(7) The solenoid may comprise a tubular electromagnet fixed at the tubular case and a plunger inserted into the tubular electromagnet; and the locking portion may comprise an engaging hole into which the plunger can be inserted.

(8) The power-feed connector may further comprise a locking member at least a first end of which is pivotally supported at the tubular case rotatably; and an interlocking moving mechanism that oscillates the first end of the locking member simultaneously with the movement of the connector body in the center axis direction of the tubular case.

(9) The interlocking moving mechanism may comprise an urging member that applies an urging force to the locking member; and an unlocking mechanism that applies an unlocking force which resists the urging force of the urging member to the locking member simultaneously with the movement of the connector body in the center axis direction of the tubular case.

(10) In the power-feed connector, a locking claw (engaging claw) may be formed at the first end of the locking member; and the unlocking mechanism may comprise an extension portion that is formed at the second end of the locking member and is extended along the center axis direction of the tubular case, a first projecting portion that is provided at the extension portion and protrudes to an outer periphery side of the connector body, and a second projecting portion that is provided at an outer periphery of the connector body and protrudes to the first projecting portion side.

(11) The power-feed connector may further comprise a regulating member that is provided in an inner portion of the tubular case, and regulates the movement of the connector body in the center axis direction of the tubular case.

(12) The regulating member may comprise a ball plunger that is provided at the tubular case, an elastic body that applies an urging force to the ball plunger from the tubular case to the connector body, and a concave portion that is formed at an outer periphery of the connector body and supports a part of the ball plunger.

(13) The power-feed connector may further comprise a grip that is fixed at the tubular case, wherein the grip and the operating lever may protrude in an opposite direction with respect to the tubular case.

According to the aspects of the present invention, an operator can operate the operating lever intuitively, and can smoothly perform a charging operation. Furthermore, according to the above aspects, a power-feed connector with a simplified inner structure can be provided.

DETAILED DESCRIPTION OF THE PREFERRED EMBODIMENTS

Hereinafter, the power-feed connector according to the embodiments of the present invention will be described with reference to FIG. 1 to FIG. 9. XYZ coordinate system is provided in FIG. 1 to FIG. 7. In the XYZ coordinate system, in a state where the power-feed connector connects to the power-receiving connector, X-Y plane shows a plane which is parallel to a cross-sectional surface in a longitudinal direction of a power-feed connector and Y-Z plane shows a plane parallel to a cross-sectional surface in a lateral direction of the power-feed connector. Furthermore, +X direction shows an upside direction of the power-feed connector and −X direction shows a downside direction of the power-feed connector. Furthermore, +Y direction shows an attaching direction of the power-feed connector and −Y direction shows a detaching direction (remove) of the power-feed connector. The XYZ coordinate system is used to describe the embodiments of the present invention more clearly, and the present invention is not limited to this.

First Embodiment

Figure 1:
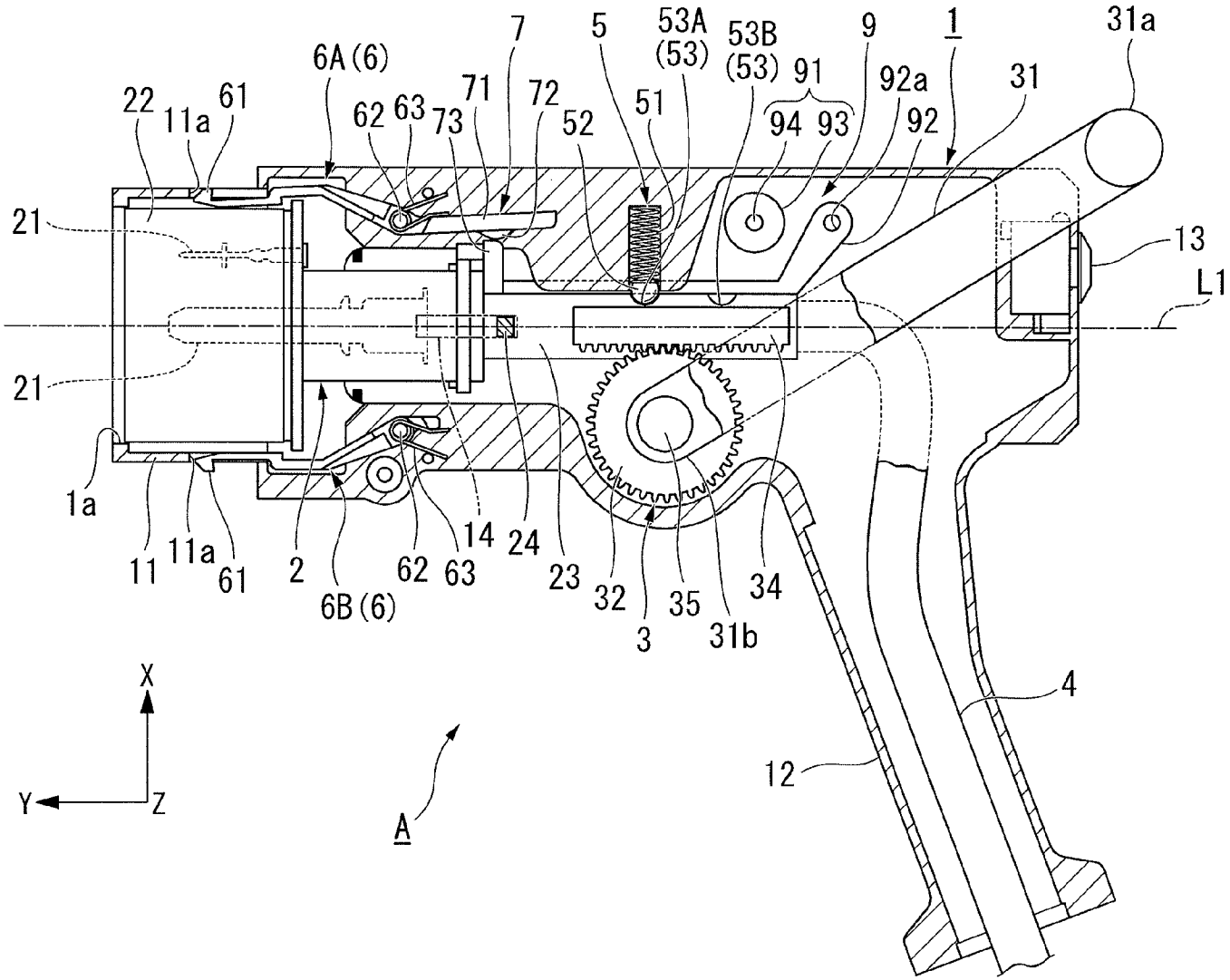
FIG. 1 is a cross-sectional view showing a power-feed connector according to a first embodiment of the present invention.

FIG. 1 is a cross-sectional view showing a power-feed connector according to a first embodiment. As shown in FIG. 1, the power-feed connector A of the present embodiment is used for a charging apparatus, such as a plug-in station, which provides electric power to an electric vehicle. The power-feed connector A connects to a power-receiving connector B (see FIG. 2) provided in an electric vehicle while charging.

The power-feed connector A includes a tubular case 1 which is formed in a tube shape, a connector body 2 which is housed in the tubular case 1, and an operating mechanism 3 for operating the movement of the connector body 2.

The connector body 2 can slidably move with respect to the tubular case 1 along a center axis L1 direction of the tubular case 1. The operating mechanism 3 operates the movement of the connector body 2 with respect to the tubular case 1.

The tubular case 1 includes a front end opening portion 1*a* which opens at the front end of the center axis L1 direction (the left side of the end portion in FIG. 1). A tubular insertion portion 11 which is inserted into a shell 101 of the power-receiving connector B is provided at a front end portion (a first end portion) of the tubular case 1. A plurality of insertion holes 11*a* are formed on the peripheral wall of the insertion portion 11. A locking claw 61 of a locking arm 6 which will be described later is provided in the insertion hole 11*a*. The number of insertion holes 11*a* is the same as the number of locking claws 61 of the locking arm 6. Here, the front end portion of the tubular case 1 is an end portion (a connecting portion) which connects to the power-receiving connector B. In FIG. 1, the front end portion is the end portion of the tubular case 1 headed in the +Y direction.

Furthermore, a grip 12 extending towards downside of the tubular case 1 is provided at the rear end portion of the tubular case 1 (a right side end portion in FIG. 1). The grip 12 extends outside along a radial direction of the tubular case 1 from the outer periphery thereof. The grip 12 is integrally fixed on the tubular case 1. The grip 12 is formed in a tubular shape, and the interior space of the grip 12 is communicated with the interior space of the tubular case 1. Furthermore, a display lamp 13, such as LED, is mounted in an end surface of the rear end portion of the tubular case 1. The display lamp 13 lights up during the charging phase; and lights out when the charging is finished.

However, the present embodiment is not limited to the above configuration. For example, instead of integrating the grip 12 and the tubular case 1, it may employ a configuration in which the grip 12 and the tubular case 1 are joined to each other by for example, screw thread.

Furthermore, the display lamp 13 is mounted in the end surface of the rear end portion of the tubular case 1 in the present embodiment, in order to enable the operator to easily see. However, the display lamp 13 may also be mounted in a side surface of the rear end portion of the tubular case 1.

Here, the rear end portion (a second portion) of the tubular case 1 is an end portion (an operating end) for operating the power-feed connector. In FIG. 1, the rear end portion is an end portion of the tubular case 1 headed to the −Y direction.

The connector body 2 is housed in the tubular case 1 such that to approach the front end portion side of the tubular case 1. The connector body 2 includes a plurality of power-feed side terminals (terminal) 21 which electrically connects to the power-receiving connector B, a tubular terminal storage portion 22 for storing a plurality of the power-feed side terminals 21, and a cable storage portion 23 for storing a cable 4. The cable 4 connects to a base end of the power-feed side terminals 21. The cable 4 is arranged such that through the grip 12 from the power-feed side terminals 21 side and extends outside of the power-feed connector A.

A power feed terminal for supplying electric power to the electric vehicle is included in the power-feed side terminals 21. Furthermore, a communication terminal, for example, for communicating information which is required for controlling the charging between the charging apparatus and the electric vehicle is included in the power-feed side terminals 21. The terminal storage portion 22 is formed such that the tip ends of the power-feed side terminals 21 approach the outside from the front end opening portion 1*a* of the tubular case 1.

The detailed number and arrangement of these power-feed side terminals 21, the detailed shape of the terminal storage portion 22, the shape of the insertion portion 11 of the tubular case 1, and the like can be set arbitrarily. For example, those specified in Japan Electric Vehicle Standard: JEVS G 105 can be employed.

The cable storage portion 23 is fixed in the rear end of the terminal storage portion 22 (−Y direction side of the terminal storage portion 22). Namely, the cable storage portion 23 is arranged at the rear end portion side of the tubular case 1 with respect to the terminal storage portion 22. A sliding pin 24 is formed in the outer periphery of the cable storage portion 23, in which the sliding pin 24 is projected outside along the radial direction of the cable storage portion 23. Furthermore, a sliding groove 14 which extends along the center axis L1 direction is formed in the inner periphery of the tubular case 1. The sliding pin 24 is stored in the sliding groove 14, and can slide in the sliding groove 14 along the center axis L1 direction. Hereby, the connector body 2 can slide with respect to the tubular case 1 along the center axis L1 direction.

The moving range of the connector body 2 with respect to the tubular case 1 is regulated by a regulating member 5 which is provided in the power-feed connector A. The regulating member 5 includes a coil spring 51, a spherical ball plunger 52, and a concave portion 53 which is formed in the outer periphery of the cable storage portion 23. The ball plunger 52 is urged (spring biased) toward the outer periphery of the cable storage portion 23 from the inner periphery side of the tubular case 1 (toward the −X direction) by the elastic force of the coil spring 51. Namely, the ball plunger 52 is regulated within the concave portion 53 by applying elastic force to the ball plunger 52 toward −X direction by the coil spring 51.

The concave portion 53 includes a first concave portion 53A and a second concave portion 53B which are arranged at intervals in the center axis L1 direction. The inner surfaces of the first concave portion 53A and the second concave portion 53B are formed in an arc-like shape corresponding to the spherical surface of the ball plunger 52. A portion of the ball plunger 52 can get into the first concave portion 53A and the second concave portion 53B.

The ball plunger 52 is formed in a spherical shape, but it is not limited to this. The ball plunger 52 can be formed in a hemispherical shape by cutting a portion of the spherule, as long as the ball plunger 52 has a spherical surface corresponding to the concave portion 53. Deepness of the first concave portion 53A and the second concave portion 53B in the X direction are not particularly limited, and can be less or equal to a radius of the ball plunger 52.

Figure 3:
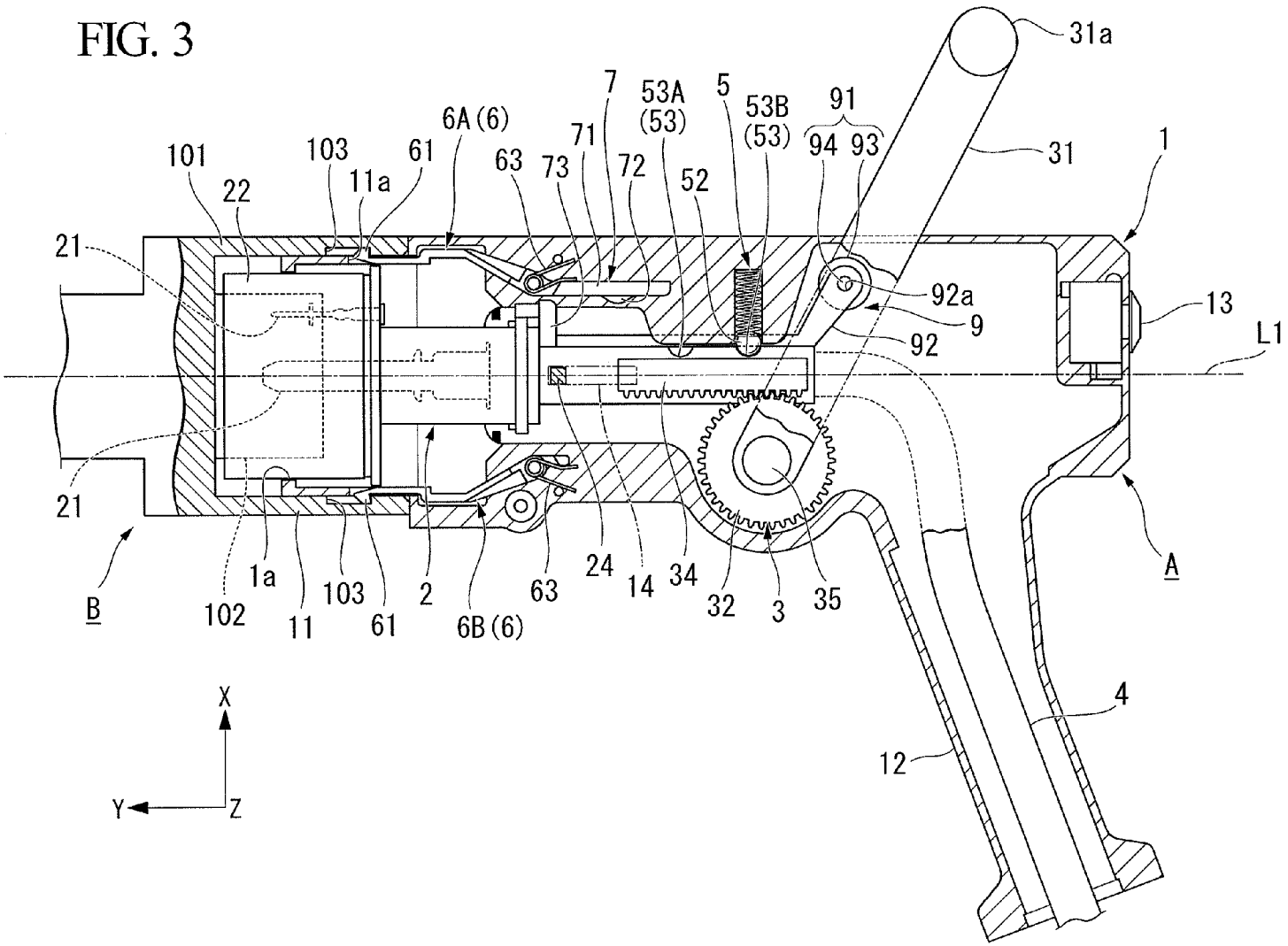
FIG. 3 is a cross-sectional view showing a state in which the power-feed connector shown in FIG. 1 connects to the power-receiving connector.

The interval between the first concave portion 53A and the second concave portion 53B equals to the maximum moving distance of the connector body 2 in the center axis L1 direction. As shown in FIG. 1, a position in which the whole terminal storage portion 22 of the connector body 2 is stored in the tubular case 1 is named a storage position. As shown in FIG. 3, a position in which a portion of the terminal storage portion 22 protrudes from the front end opening portion 1*a* of the tubular case 1 is named a protruding position.

The connector body 2 can move from the storage position to the protruding position or from the protruding position to the storage position. The maximum moving distance of the connector body 2 in the center axis L1 direction is a distance from the storage position to the protruding position.

Namely, in a sate in which the connector body 2 is in the storage position, the movement of the connector body 2 is regulated by putting the ball plunger 52 into the first concave portion 53A which is positioned in the front end side of the tubular case 1. Further, in a state in which the connector body 2 is in the protruding position, the movement of the connector body 2 is regulated by putting the ball plunger 52 into the second concave portion 53B which is positioned in the rear end side of the tubular case 1.

In the regulating member 5, since the inner surface of the concave portion 53 is formed in an arc-like shape corresponding to the ball plunger 52, when a force which is larger than an urging force of the coil spring 51 is applied by an operating mechanism 3 described later, the ball plunger 52 resists the urging force of the coil spring 51 and can move between the first concave portion 53A and the second concave portion 53B. Namely, the connector body 2 can move to a direction to protrude from the front end opening portion 1*a* from a state in which the connector body 2 is in a storage position. Furthermore, the connector body 2 can move to a direction to storage in the tubular case 1 from a state in which the connector body 2 is in a protruding position.

The operating mechanism 3 is provided in the rear end portion of the tubular case 1. The operating mechanism 3 includes an operating lever 31 which is pivotally supported such that it can rotate with respect to the tubular case 1, a spur gear 32 which rotates in association with the rotation of the operating lever 31, and a rack 34 which engages with the spur gear 32. The rack 34 is fixed in the connector body 2, and can move along the center axis L1 direction in association with the rotation of the spur gear 32. A conversion mechanism which converts the rotating force of the operating lever 31 into a force only along a center axis direction of the tubular case is constructed by the spur gear 32 and the rack 34.

Within the tubular case 1, the rack 34 is fixed in the cable storage portion 23. Dents which engage to the spur gear 32 are formed in the rack 34 along the center axis L1 direction. The forming face of the dents of the rack 34 is directed to the same side of the protruding direction of the grip 12 (downside in FIG. 1). Namely, the dents of the rack 34 are directed to the downside direction of the power-feed connector A. In FIG. 1, the rack 34 is fixed in the outer periphery of the cable storage portion 23, such that the rack 34 does not interfere with the cable 4 extended from the rear end of the cable storage portion 23.

A first end (free end) 31*a* of the operating lever 31 in a longitudinal direction protrudes outside the tubular case 1. A second end (fixed end) 31*b* of the operating lever 31 in the longitudinal direction is pivotally supported in the tubular case 1 by a lever axis 35. In FIG. 1, the second end 31*b* of the operating lever 31 is arranged within the tubular case 1. However, it is not limited to this, for example, the lever axis 35 can protrude outside the tubular case 1, same as the first end 31*a*, the second end 31*b* can be arranged outside the tubular case 1.

Furthermore, in a Y-Z plane (a horizontal plane in a usage state) in FIG. 1, an axis direction of the lever axis 35 is perpendicular to the center axis L1 direction. Hereby, the operating lever 31 can rotate in an X-Y plane (a vertical plane in a usage state) in FIG. 1. Namely, the operating lever 31 can rotate within a fictive plane which extends in the center axis L1 direction. The fictive plane (X-Y plane) includes planes including the center axis L1, and planes along the center axis L1 (parallel to the center axis L1, and not including the center axis L1).

The lever axis 35 and the second end 31*b* of the operating lever 31 are positioned in the lower side of the forming face of the dents of the rack 34 which is directed to the downside (−X direction). The first end 31*a* of the operating lever 31 is positioned in the upper side of the forming face of the dents of the rack 34. In other words, the first end 31*a* of the operating lever 31 is arranged at an opposite side of the forming face of the dents of the rack 34. The operating lever 31 protrudes away from the center axis L1 with respect to the tubular case 1 (direct to −Y and −X direction) and oppositely to the protruding direction of the grip 12.

The spur gear 32 is arranged at a lower side of the forming face of the dents of the rack 34 to engage with the rack 34 within the tubular case 1, and is pivotally supported in the tubular case 1 integrated with the operating lever 31 by the lever axis 35.

In the above configured operating mechanism 3, the first end 31*a* of the operating lever 31 is a power point for rotating the operating lever 31 by an operator, and the second end 31*b* of the operating lever 31 is a supporting point of the operating lever 31. The engaging portion of the rack 34 and the spur gear 32 which is integrally fixed in the operating lever 31 is an action point which applies the rotating force of the operating lever 31 to the connector body 2 so that the connector body 2 moves in the center axis L1 direction. Since the action point is positioned between the power point and the supporting point of the operating lever 31, the moving direction of the first end 31*a* of the operating lever 31 coincides with the moving direction of the connector body 2 which moves associated with the rotation of the operating lever 31.

The power-feed connector A of the present embodiment includes a plurality of (two in the FIGS) locking arms 6 which are provided at the front end side of the tubular case 1 and lock the power-feed connector A to the power-receiving connector B. The plurality of locking arms 6 are arranged at a circumferential direction of the tubular case 1 such that to surround the connector body 2. A first locking arm 6A and a second locking arm 6B are shown in FIG. 1. However, it is not limited to this, and more than two locking arms can be provided.

Each of the locking arms 6 is formed in a rod-like shape which extends in the center axis L1 direction. A locking claw 61 is formed in the front end (a first end) of the locking arm 6, in which the locking claw 61 protrudes outside along the radial direction of the tubular case 1. The rear end (a second end) of the locking arm 6 is pivotally supported in the tubular case 1 by pin 62. Namely, each of the locking arms 6 is mounted such that it can swing with respect to the tubular case 1.

In addition, a torsion spring 63 is mounted at the pin 62. The locking arms 6 are urged (spring biased) to a swing direction such that a front end side of the locking arm 6 moves to outside along the radial direction of the tubular case 1, due to the urging force of the torsion spring 63. Namely, due to the urging force of the torsion spring 63, the front end side of the locking arm 6 is urged to the radial direction of the tubular case 1. In this urging state, the locking claw 61 protrudes outside from the insertion hole 11*a* of the tubular case 1.

Furthermore, the power-feed connector A of the present embodiment includes an unlocking mechanism 7. The unlocking mechanism 7 resists the urging force of the torsion spring 63 and retracts the locking claw 61 of the first locking arm 6A into the tubular case 1. The unlocking mechanism 7 includes an extension portion 71 which extends from the rear end of the first locking arm 6A further to the rear end side of the tubular case 1 along the center axis L1, a first protruding portion 72 which is formed at the extension portion 71, and a second protruding portion 73 which is formed at the outer periphery of the connector body 2.

The extension portion 71 is placed face to the outer periphery of the cable storage portion 23. The first protruding portion 72 protrudes toward the outer periphery of the cable storage portion 23. The protruding height of the first protruding portion 72 is set to not make contact with the outer periphery of the cable storage portion 23.

The second protruding portion 73 protrudes toward the extension portion 71, and when the connector body 2 is placed in the protruding position (see FIG. 3), the second protruding portion 73 does not make contact with the first protruding portion 72 or the extension portion 71. On the other hand, when the connector body 2 is placed in the storage position (see FIG. 1), the second protruding portion 73 comes into contact with the first protruding portion 72. Due to the contact made between the second protruding portion 73 and the first protruding portion 72, the second protruding portion 73 resists the urging force of the torsion spring 63, and the extension portion 71 is pressed to the outside along the radial direction of the tubular case 1. As a result, the locking claw 61 of the first locking arm 6A is retracted into the tubular case 1.

Namely, the unlocking mechanism 7 works simultaneously with the operation of the operating lever 31, and can move the locking claw 61 of the first locking arm 6A between the retracted position (a position shown in FIG. 1) in which the locking claw 61 is retracted into the tubular case 1 and the protruding position (a position shown in FIG. 3) in which the locking claw 61 protrudes outside from the insertion hole 11*a* along the radial direction of the tubular case 1.

The power-feed connector A of the present embodiment includes an electromagnetic locking mechanism 9 which prevents the connector body 2 from moving with respect to the tubular case 1 while charging. The electromagnetic locking mechanism 9 includes a solenoid 91 fixed at the tubular case 1, and a locking portion 92 provided at the connector body 2. The solenoid 91 includes a tubular electromagnet 93 fixed at the tubular case 1, and a plunger 94 which is inserted into the electromagnet 93. The locking portion 92 includes an engaging hole 92*a* into which the plunger 94 is inserted. As shown in FIG. 1, the locking portion 92 is provided at the connector body 2 as a separate member. However, it is not limited to this; for example, the locking portion 92 can be formed integrally with the connector body 2.

The plunger 94 of the solenoid 91 is housed in the electromagnet 93 by an urging member (now shown) or the like, in a state in which the electrical current does not flow in the electromagnet 93. The plunger 94 protrudes from the electromagnet 93 in a state in which the electrical current flows in the electromagnet 93. The electric power is supplied to the electromagnet 93 while charging (when supply the electric power to the electric vehicle). Specifically, the electric power is supplied to the electromagnet 93 due to the electric power which is supplied to the electric vehicle flows into the electromagnet 93. Therefore, in the present embodiment, it is not necessary to provide an extra electric power supplying device.

In a state in which the connector body 2 is positioned in the storage position, the engaging hole 92*a* of the locking portion 92 is positioned off the plunger 94 (original position), and the plunger 94 does not inserted into the engaging hole 92*a*, even if the plunger 94 protrudes. Namely, the distance between the plunger 94 and the engaging hole 92*a* in the state in which the connector body 2 is positioned in the storage position (a state shown in FIG. 1) corresponds to a distance from the storage position to the protruding position of the connector body 2.

Furthermore, in a state in which the connector body 2 is positioned in the protruding position, the locking portion 92 is positioned such that the plunger 94 protruding from the electromagnet 93 can be inserted into the engaging hole 92*a* (insertion position). Namely, in a state in which the connector body 2 is positioned in the protruding position, the engaging hole 92*a* of the locking portion 92 is placed in the insertion position, and the plunger 94 protrudes from the electromagnet 93 and is inserted into the engaging hole 92*a* when the electrical current flows into the electromagnet 93.

Therefore, in association with the movement of the connector body 2 from the storage position to the protruding position, the locking portion 92 provided at the connector body 2 is also moved from the original position to the insertion position. When the locking portion 92 is positioned in the insertion position and the charging is started, the electrical current flows into the electromagnet 93, and the plunger 94 is inserted into the engaging hole 92*a* of the locking portion 92. Hereby, the electromagnetic locking mechanism 9 regulates the movement of the connector body 2 during charging. As a result, the power-feed side terminal 21 of the power-feed connector A can be reliably prevented from pulling off from the power-receiving side terminal of the power-receiving connector B during charging.

When the charging is completed, the supply of the electric power to the electromagnet 93 is stopped, and the plunger 94 is released from the engaging hole 92*a* of the locking portion 92. Namely, the connector body 2 can be moved.

In the past, in order to prevent the movement of the connector body during charging, a locking member is provided at the power-feed connector. After charging, the lock of the locking member is released by manually operating a releasing member or the like which is provided at the outside of the power-feed connector. However, since the releasing member is provided at the outside of the power-feed connector, there is high possibility that the engagement of the locking member is released while charging caused by an erroneous operation. According to the electromagnetic locking mechanism 9 of the present embodiment, the lock and the release of the connector body can be performed automatically simultaneously with the charging performance. Therefore, there is no need to provide the releasing member outside, and the occurrence of the erroneous operation can be reliably prevented.

Furthermore, in the past, in order to release the lock of the locking member, an operation of the releasing member is required, and a problem such that it takes a lot of trouble with the charge is occurred. However, according to the electromagnetic locking mechanism 9 of the present embodiment, the manual operation of the release is not necessary, and the charging operation can be performed more easily and more efficiently.

Furthermore, in the past, while connecting the power-feed connector to the power-receiving connector to charge, it is necessary to manually operate the locking member in order to regulate the movement of the connector body. However, according to the present embodiment, the connector body is locked automatically in association with the beginning of the charging without an extra operation. Therefore, according to the present embodiment, the charging operation can be performed more easily and more efficiently.

Figure 2:
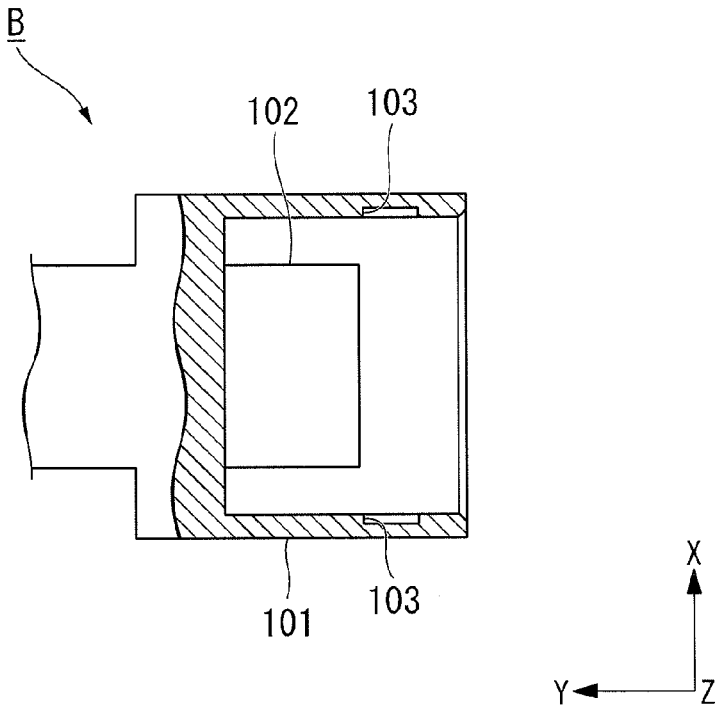
FIG. 2 is a cross-sectional view showing a power-receiving connector which connects to the power-feed connector shown in FIG. 1.

The power-receiving connector B which connects to the power-feed connector A having above configuration is fixed at a vehicle body or the like of the electric vehicle. As shown in FIG. 2, the power-receiving connector B includes a tubular shell 101 which accommodates the insertion portion 11 of the tubular case 1, a tubular terminal storage portion 102 which is provided at an inner portion of the tubular shell 101, and a power-receiving side terminal (now shown) provided in the terminal storage portion 102. In a state in which the insertion portion 11 of the tubular case 1 is accommodated within the shell 101 (see FIG. 3), the terminal storage portion 102 is accommodated within the terminal storage portion 22 of the connector body 2. Namely, the shapes of the shell 101 and the terminal storage portion 102 correspond to the shape of the insertion portion 11 and the terminal storage portion 22 of the power-feed connector A respectively. A locking concave portion 103 is formed at the inner periphery of the shell 101, in which the locking concave portion 103 engages with the locking claw 61 of the power-feed connector A. The number and the arrangement of the locking concave portions 103 correspond to the number and the arrangement of the locking arms 6.

The power-feed connector A and the power-receiving connector B are electrically connected by making contacting with or abutting against the power-receiving side terminal to the power-feed side terminal 21 of the power-feed connector A. The power-receiving side terminal has the same function as the power-feed side terminal 21. Namely, the number and arrangement of the power-receiving side terminal correspond to that of the power-feed side terminal 21 of the power-feed connector A.

When connecting the power-feed connector A which has the above configuration to the power-receiving connector B, as shown in FIG. 1, in a state in which the connector body 2 is placed in the storage position, the operator grips the grip 12 and inserts the front end portion (insertion portion 11) of the tubular case 1 into the shell 101, such that the power-feed connector A is plugged into the power-receiving connector B. In this state, as shown in FIG. 3, the locking claw 61 of the second locking arm 6B engages with the locking concave portion 103 of the power-receiving connector B, so that a state is achieved in which the power-feed connector A preliminarily engages with the power-receiving connector B.

Then, the connector body 2 is moved to the front end side of the tubular case 1 through the operating mechanism 3, such that the connector body 2 is placed at the protruding position. Specifically, the connector body 2 is moved to the front end side of the tubular case 1 and is placed at the protruding position, by gripping the first end 31*a* of the operating lever 31 and rotating the operating lever 31 such that the first end 31*a* of the operating lever 31 moves to the front end side of the tubular case 1 by an operator.

In this state, the second protruding portion 73 of the unlocking mechanism 7 moves together with the connector body 2 and moves away from the first protruding portion 72 through the operation of the operating lever 31. Therefore, the locking claw 61 of the first locking arm 6A protrudes outside from the insertion hole 11*a* of the tubular case 1, and engages with the locking concave portion 103 of the power-receiving connector B, by the urging force of the torsion spring 63. Hereby, the power-feed connector A fully engages with the power-receiving connector B. In this state, the power-feed side terminal 21 makes contact with or abuts against the power-receiving side terminal, and the power-feed connector A electrically connects to the power-receiving connector B, so that it becomes a chargeable state.

While rotating the operating lever 31, the locking claw 61 of the first locking arm 6A engages with the locking concave portion 103 of the power-receiving connector B, and then the power-feed connector A electrically connects to the power-receiving connector B.

Furthermore, in this fully engaged state, the engaging hole 92*a* of the locking portion 92 is placed at a position corresponding to the plunger 94. When the charging is started in this fully engaged state, the electrical current flows in the electromagnet 93, and the plunger 94 is inserted into the engaging hole 92*a* of the locking portion 92. The electromagnetic locking mechanism 9 prevents the connector body 2 from moving, and can reliably prevent the power-feed side terminal 21 of the power-feed connector A from pulling off the power-receiving side terminal of the power-receiving connector B during charging.

When the charging has been completed, the supply of the electric power to the electromagnet 93 is stopped, and the plunger 94 is released from the engaging hole 92*a* of the locking portion 92. Namely, the connector body 2 can move.

Then, when detaching the power-feed connector A from the power-receiving connector B from a state in which the power-feed connector A is fully engaged with the power-receiving connector B, at first, an operator grips the first end 31*a* of the operating lever 31 and rotates the operating lever 31 so that the first end 31*a* of the operating lever 31 moves to the rear end side of the tubular case 1. Hereby, the connector body 2 moves to the rear end side of the tubular case 1, and is positioned at the storage position.

In this stage, the second protruding portion 73 of the unlocking mechanism 7 moves together with the connector body 2 and connects (abuts against) to the first protruding portion 72 by operating the operating lever 31. Hereby, the second protruding portion 73 resists the urging force of the torsion spring 63 and presses the extension portion 71 to the outside along the radial direction of the tubular case 1, and the locking claw 61 of the first locking arm 6A retracts into the tubular case 1. Namely, it returns to the state in which the power-feed connector A is preliminarily engaged with the power-receiving connector B.

Then, a detachment operation of the power-feed connector A completed by gripping the grip 12 and pulling out the power-feed connector A from the power-receiving connector B.

In the preliminary engaging state, even though the locking claw 61 of the second locking arm 6B engages with the power-receiving connector B, the engagement of the locking claw 61 of the first locking arm 6A with the power-receiving connector B released. Therefore, the power-feed connector A easily pulled out since the engaging force between the power-feed connector A and the power-receiving connector B is impaired.

As described above, according to the power-feed connector A of the present embodiment, since the moving directions of the first end 31*a* of the operating lever 31 and the connector body 2 are coincident, an operator can operate the operating lever 31 intuitively. In addition, the connecting operation (attaching operation) and the detaching operation (dismounting operation) of the power-feed connector A and the power-receiving connector B can be performed by operating the operating lever 31, the charging operation can be performed smoothly.

Since the operating mechanism 3 consists of the gear mechanism which uses the spur gear 32 and the rack 34, the rotation movement of the operating lever 31 can be reliably converted into an advance or retracted movement of the connector body 2. Furthermore, since the operating mechanism 3 consists of the gear mechanism, compare to the conventional configuration, the number of component parts can be reduced; and the cost for manufacturing the power-feed connector A can be reduced. In addition, the maintenance of the power-feed connector A can be improved.

Furthermore, since the second end 31*b* of the operating lever 31 and the spur gear 32 are placed at the forming face side of the dents of the rack 34, and the first end 31*a* of the operating lever 31 is placed at a side opposite to the forming face side of the dents of the rack 34, the number of spur gears 32 can be set to one, in which the spur gear 32 is required to coincide with the moving directions of the first end 31*a* of the operating lever 31 and the connector body 2. Namely, the number of component parts of the operating mechanism 3 can be minimized, and the cost for manufacturing the power-feed connector A can be reduced.

Since the operating lever 31 and the grip 12 protrude inversely and away from the center axis L1 with respect to the tubular case 1, the operator can grip the grip 12 with either right or left hand, and operate the operating lever 31 with the other hand. Namely, an operator whose dominant hand is right or left can easily use the power-feed connector A.

Furthermore, according to the power-feed connector A of the present embodiment, the operating mechanism 3 is only composed of the gear mechanism without the link mechanism as conventional way, the axis of the connector body 2 can be prevent from shifting. Therefore, the connector body 2 can smoothly protrude from the tubular case 1 within the shell 10 of the power-receiving connector B.

Specifically, as a conventional way, when the rotation movement of the operating lever 31 is converted into a linear movement of the connector body 2 using the link mechanism, a force in a direction orthogonal to the center axis L1 is applied to the connector body 2 which is caused by the rotation of the operating lever 31. Therefore, the axis of the connector body 2 may shift. On the other hand, in the power-feed connector A of the present embodiment, the rotation movement of the operating lever 31 is converted into the linear movement of the connector body 2 only using the gear mechanism. Therefore, a force only in the center axis L1 direction is applied to the rack 34 and the connector body 2. Namely, no force in the direction orthogonal to the center axis L1 is applied to the connector body 2. As a result, the axis of the connector body 2 can be prevented from shifting.

In addition, according to the power-feed connector A of the present embodiment, the power-feed connector A and the power-receiving connector B can be switched between the preliminary engaging state and the fully engaged state simultaneously with the operation of the operating lever 31. Therefore, the operation performance of the power-feed connector A can be further improved.

Furthermore, according to the power-feed connector A of the present embodiment, the rack 34 is fixed at the outer periphery of the connector body 2. Thereby, when compare to a case in which the rack 34 or the spur gear 32 is fixed at the rear end side of the cable storage portion 23, the dimension of the tubular case 1 in the longitudinal direction (center axis L1 direction) can be set to short, thus miniaturization of the power-feed connector A can be achieved.

In addition, since the rack 34 or the spur gear 32 is not placed at the rear end portion of the tubular case 1, the routing of the cable extended from the cable storage portion or the arrangement of the display lamp 13 can be easily set. Namely, the design of the power-feed connector A becomes easier.

The power-feed connector of the first embodiment of the present invention has been described. However, the present invention is not limited to the above-described embodiment, and various modifications can be made without departing from the scope of the present invention.

For example, the configuration of the operating mechanism 3, which is used to coincide with the moving directions of the first end 31*a* of the operating lever 31 and the connector body 2, is not limited to the gear mechanism described above. An operation mechanism can be employed, in which an action point thereof that applies the rotating force of the operating lever 31 to the connector body 2 is placed between the power point (first end 31*a*) of the operating lever 31 and the supporting point (second end 31*b*) of the operating lever 31.

In such a configuration, for example, the same as in the above-described embodiment, the first end 31*a* of the operating lever 31 protrudes outside the tubular case 1, and the second end 31*b* of the operating lever 31 is pivotally supported at the tubular case 1. In addition, a connecting shaft rotatably connects a midway portion of the operating lever 31 in the longitudinal direction and the connector body 2. In this configuration, for example, when the connecting shaft is fixed at the connector body 2, it is only necessary to form a connecting hole into which the connecting shaft inserted at the operating lever 31. The connecting hole may be formed as a long hole extended along the longitudinal direction of the operating lever 31, such that the connecting shaft can move along the longitudinal direction of the operating lever 31.

In this configuration, the connecting portion of the midway portion of the operating lever 31 and the connector body 2 becomes the action point which applies the rotating force of the operating lever 31 to the connector body 2. Therefore, the same as in the above-described embodiment, the moving directions of the first end 31*a* of the operating lever 31 and the connector body 2 can coincide with each other. Namely, the same effect as that in the above-described embodiment can be achieved.

The alignment position of the action point which applies the rotating force of the operating lever 31 to the connector body 2 is not limited in the straight line connecting the power point (first end 31*a*) of the operating lever 31 and the supporting point (second end 31*b*) of the operating lever 31. The action point can be placed at a position in which an angle between a direction towards the power point from the supporting point of the operating lever 31 and a direction towards the action point from the supporting point is smaller than 180 degrees. The angle can be set to a small angle (for example, equal to or less than 90 degrees).

As such a configuration, for example, an operating piece is formed at the operating lever 31 integrally, such that the operating piece is shifted a predetermined angle with respect to the operating lever 31, and a connecting shaft rotatably connects the tip end portion of the operating piece and the connector body 2. The operating piece extends along a direction moving away from the second end 31*b* of the operating lever 31. In addition, the first end 31*a* of the operating lever 31 protrudes outside the tubular case 1, and the second end 31*b* of the operating lever 31 is pivotally supported at the tubular case 1. Namely, in this configuration, the tip end portion of the operating piece functions as the action point.

In this configuration, the dimension of the operating piece in the longitudinal direction may be smaller than the dimension of the operating lever 31 in the longitudinal direction. In addition, in this configuration, for example, when the connecting shaft is fixed at the connector body 2, it is only necessary to form the connecting hole into which the connecting shaft inserted at the tip end portion of the operating piece. The connecting hole may be formed as a long hole extended along the longitudinal direction of the operating piece, such that the connecting shaft can move along the longitudinal direction of the operating piece.

Such a configuration can also make the moving direction of the first end 31*a* of the operating lever 31 coincides with the moving direction of the connector body 2. Especially, by setting the angle between a direction towards the power point from the supporting point of the operating lever 31 and the direction towards the action point of the operating piece from the supporting point to be less or equal to 90 degrees, and by setting the longitudinal dimension of the operating piece smaller than that of the operating lever, the action point substantively placed between the supporting point and the power point. Therefore, the moving direction of the first end 31*a* of the operating lever 31 reliably coincides with the moving direction of the connector body 2.

Furthermore, in the above-described embodiment, the regulating member 5 for regulating the moving range of the connector body 2 includes the ball plunger 52 provided at the tubular case 1 side, and the concave portion 53 formed at the connector body 2. However, it is not limited to this, for example, the regulating member 5 can be made up of the sliding groove 14 of the tubular case 1 for housing the sliding pin 24 of the connector body 2, or, for example, can be formed so as to regulate the rotating angle range of the operating lever 31.

In the above-described embodiment, the power-feed connector A provided for the charging apparatus for the electric vehicle is described. However, the power-feed connector of the present invention can also be applied to a charging apparatus for various electric machines which are driven by electric power.

While connecting the power-feed connector of the above-described embodiment of the present invention to the power-receiving connector, for example, the front end opening portion of the tubular case is plugged into the power-receiving connector, and the tubular case is attached to the power-receiving connector. After that, by moving the connector body to the front end side of the tubular case through the operating mechanism, the terminals of the power-feed connector electrically connect to the terminals of the power-receiving connector. While detaching the power-feed connector from the power-receiving connector, by moving the connector body to the rear end side of the tubular case through the operating mechanism, the electrical connection between the power-feed connector and the power-receiving connector is broken.

In this power-feed connector, since the action point (engaging point of the spur gear and the rack) of the rotating force of the operating lever is placed between the power point (first end) of the operating lever and the supporting point (second end) of the operating lever, the moving directions of the first end of the operating lever and the connector body become coincident to each other. For the detailed description of the moving direction, for example, when an operator grips the first end of the operating lever, and rotates the operating lever such that the first end of the operating lever moves to the front end side of the tubular case, the connector body moves to the front end side of the tubular case. On the other hand, for example, when an operator rotates the operating lever such that the first end of the operating lever moves to the rear end side of the tubular case, the connector body moves to the rear end side of the tubular case.

Therefore, according to the power-feed connector, since the moving direction of the first end of the operating lever coincides with the moving direction of the connector body, the operator can intuitively operate the operating lever. In addition, the connecting operation and the detaching operation between the power-feed connector and the power-receiving connector can be achieved by operating the operating lever; the charging operation can be performed smoothly.

Since the operating mechanism is made up of the gear mechanism using the spur gear and the rack, the rotation movement of the operating lever can be reliably converted into the advance or retracted movement of the connector body. Furthermore, since the operating mechanism is made up of the gear mechanism, when compare to the conventional configuration, the number of component parts can be reduced; and the cost for manufacturing the power-feed connector can be reduced. In addition, the maintenance of the power-feed connector can be improved.

Furthermore, according to this power-feed connector, the number of spur gears can be held in one, in which the spur gear is required to coincide with the moving direction of the first end of the operating lever with the moving direction of the connector body. Namely, the number of component parts of the operating mechanism can be kept to the minimum, and the cost for manufacturing the power-feed connector can be reduced.

Second Embodiment

Herein after, a power-feed connector C of a second embodiment of the present invention will be described. Here, only the difference with the first embodiment will be described, and the same parts as those of the power-feed connector A are denoted by the same reference numerals, and thus a detailed description thereof will be omitted.

Figure 4:
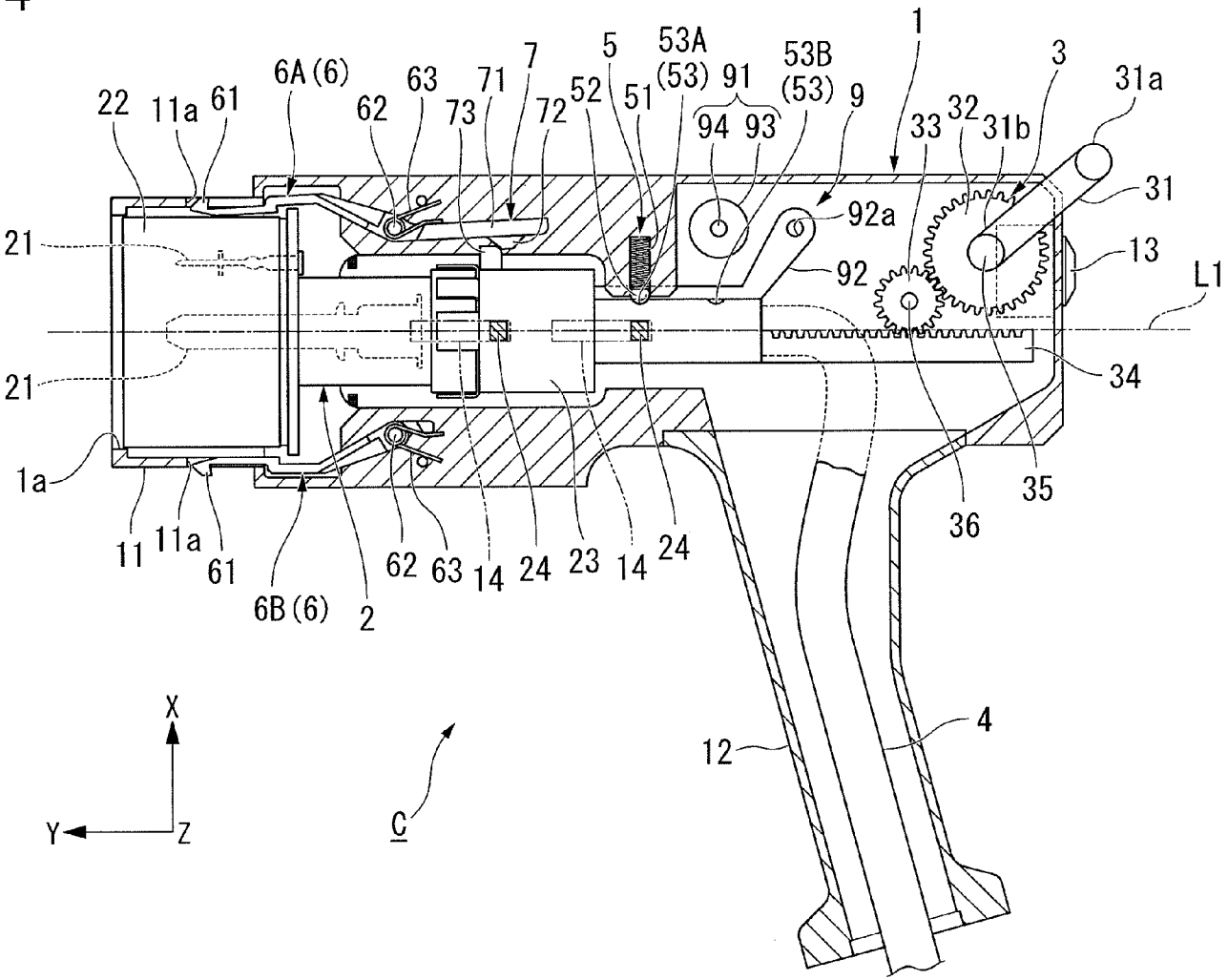
FIG. 4 is a cross-sectional view showing a power-feed connector according to a second embodiment of the present invention.
Figure 5:
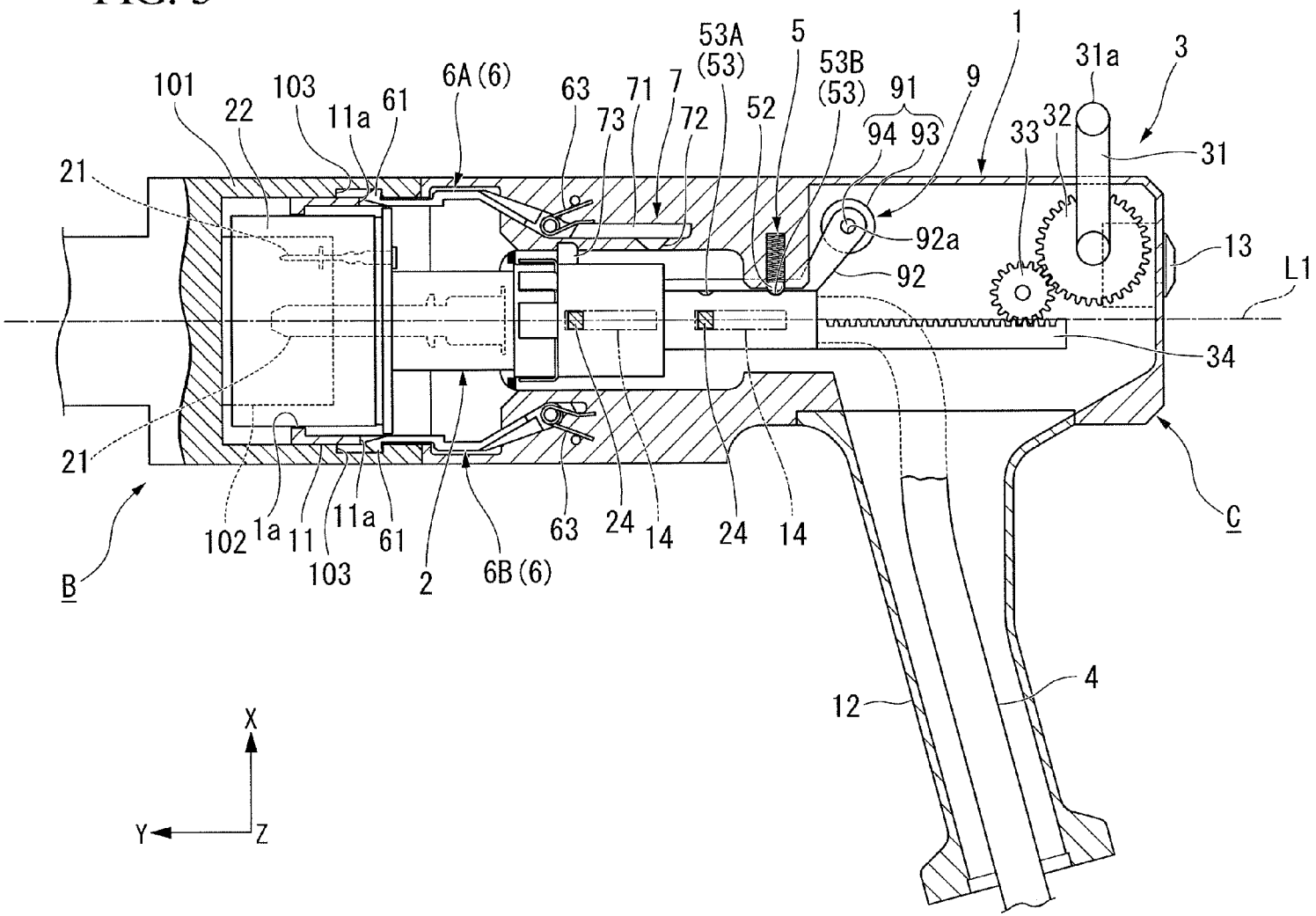
FIG. 5 is a cross-sectional view showing a state in which the power-feed connector shown in FIG. 4 connects to the power-receiving connector.

FIG. 4 and FIG. 5 is horizontal cross-sectional view showing the power-feed connector C of the second embodiment. FIG. 4 shows a state in which the connector body 2 is placed at the storage position. FIG. 5 shows a state in which the connector body 2 is placed at the protruding position in which the connector body 2 protrudes from the front end opening portion 1*a*.

As shown in FIG. 4, in the present embodiment, the operating mechanism 3 is provided at the rear end portion side of the tubular case 1. The operating mechanism 3 includes an operating lever 31 which is pivotally supported such that it can rotate with respect to the tubular case 1, a first spur gear 32 which rotates in association with the rotation of the operating lever 31, a second spur gear 33 which engages with first spur gear 32, and a rack 34 which is fixed at the connector body 2 and moves along the center axis L1 direction in association with the rotation of the first and the second spur gear 32, 33. A conversion mechanism which converts the rotating force of the operating lever 31 only into a force in the center axis direction of the tubular case is made up by this first and second spur gear 32, 33 and the rack 34.

The rack 34 is placed within the tubular case 1, and is fixed at the rear end of the cable storage portion 23. Dents which are engage to the second spur gear 33 described later are arranged at the rack 34 along the center axis L1 direction. The forming face of the dents of the rack 34 is faced to a side opposite to a protruding direction of the grip 12. Namely, the dents of the rack 34 are formed such that face to upside (+X direction) of the power-feed connector. In FIG. 4, since the cable 4 extends from the rear end of the cable storage portion 23, the setting position of the rack 34 with respect to the cable storage portion 23 may be set to a position, which does not to interfere with the cable 4. Specifically, for example, the cable 4 and the rack 34 may be arranged along a width direction (a direction perpendicular to the paper plane in FIG. 1; Namely, Z direction) of the tubular case 1.

The first end (free end) 31*a* of the operating lever 31 in the longitudinal direction protrudes outside the tubular case 1. The second end (fixed end) 31*b* of the operating lever 31 in the longitudinal direction is pivotally supported at the tubular case 1 through the lever axis 35. The second end 31*b* of the operating lever 31 may be provided within the tubular case 1. However, for example, the lever axis 35 may protrude outside the tubular case 1, such that the second end 31*b* may be provided outside the tubular case 1 same as the first end 31*a*.

Furthermore, in Y-Z plane, the axis direction of the lever axis 35 is perpendicular to the center axis L1 direction.

Thereby, the operating lever 31 can rotate within the fictive plane (X-Y plane) extending along the center axis L1 direction.

Furthermore, the lever axis 35 and the second end 31*b* of the operating lever 31 are positioned above the forming face of the dents of the rack 34. The first end 31*a* of the operating lever 31 is positioned further above the forming face of the dents of the rack 34 than the lever axis 35. In other words, the first end 31*a* of the operating lever 31 is placed at the forming face side of the dents of the rack 34.

The operating lever 31 protrudes opposite to the protruding direction of the grip 12 such that it moves away from the center axis L1 with respect to the tubular case 1.

The first and the second spur gear 32, 33 are provided within the tubular case 1. The first spur gear 32 is pivotally supported at the tubular case 1 integrally with the operating lever 31 through the lever axis 35. The second spur gear 33 is pivotally supported at the tubular case 1 through the pin 36, such that it can engage with both of the rack 34 and the first spur gear 32.

In the operating mechanism 3 having above configuration, since the first and the second spur gear 32, 33 are interposed between the operating lever 31 and the rack 34, and the first end 31*a* of the operating lever 31 is placed at the forming face side of the dents of the rack 34, the moving direction of the first end 31*a* of the operating lever 31 coincides with the moving direction of the connector body 2 which moves in association with the rotation of the operating lever 31.

In the present embodiment, since the operating mechanism 3 is made up of the gear mechanism using the first and the second spur gear 32, 33 and the rack 34, the rotation movement of the operating lever 31 can be reliably converted into the advance or retracted movement of the connector body 2. Furthermore, since the operating mechanism 3 is made up of the gear mechanism, when compare to the conventional configuration, the number of component parts can be reduced, and the cost for manufacturing the power-feed connector C can be reduced. Furthermore, the maintenance of the power-feed connector C can be improved.

Furthermore, since the entire operating lever 31 is provided at the forming face side of the dents of the rack 34 together with the first and the second spur gear 32, 33, the operating mechanism 3 can be formed compactly, thus the miniaturization of the tubular case 1 can be achieved.

In addition, since a plurality of the first and the second spur gear 32, 33 for forming the operating mechanism 3 is provided such that they engage with each other, by making the radius or the number of dents of the plurality of the first and the second spur gear 32, 33 different, a power-feed connector can be set such that even a worker whose power is week can operate the operating lever 31 sufficiently, without changing the length of the operating lever 31. Furthermore, when compared to a case in which the length of the operating lever 31 is changed, the size of the power-feed connector C can be kept in a compact size. As a result, the miniaturization of the power-feed connector C can be achieved.

In addition, since the operating lever 31 and the grip 12 protrude oppositely away from the center axis L1 with respect to the tubular case 1, an operator can grip the grip 12 with the right or left hand, and using the other hand to operate the operating lever 31. Namely, an operator whose dominant hand is right or left can easily use the power-feed connector C.

Third Embodiment

A power-feed connector of a third embodiment of the present invention will be described with reference to FIG. 6 and FIG. 7. Here, only the difference between the first and the second embodiments will be described, and the same parts as those of the power-feed connectors A and C are denoted by the same reference numerals, and thus a detailed description thereof will be omitted.

Figure 6:
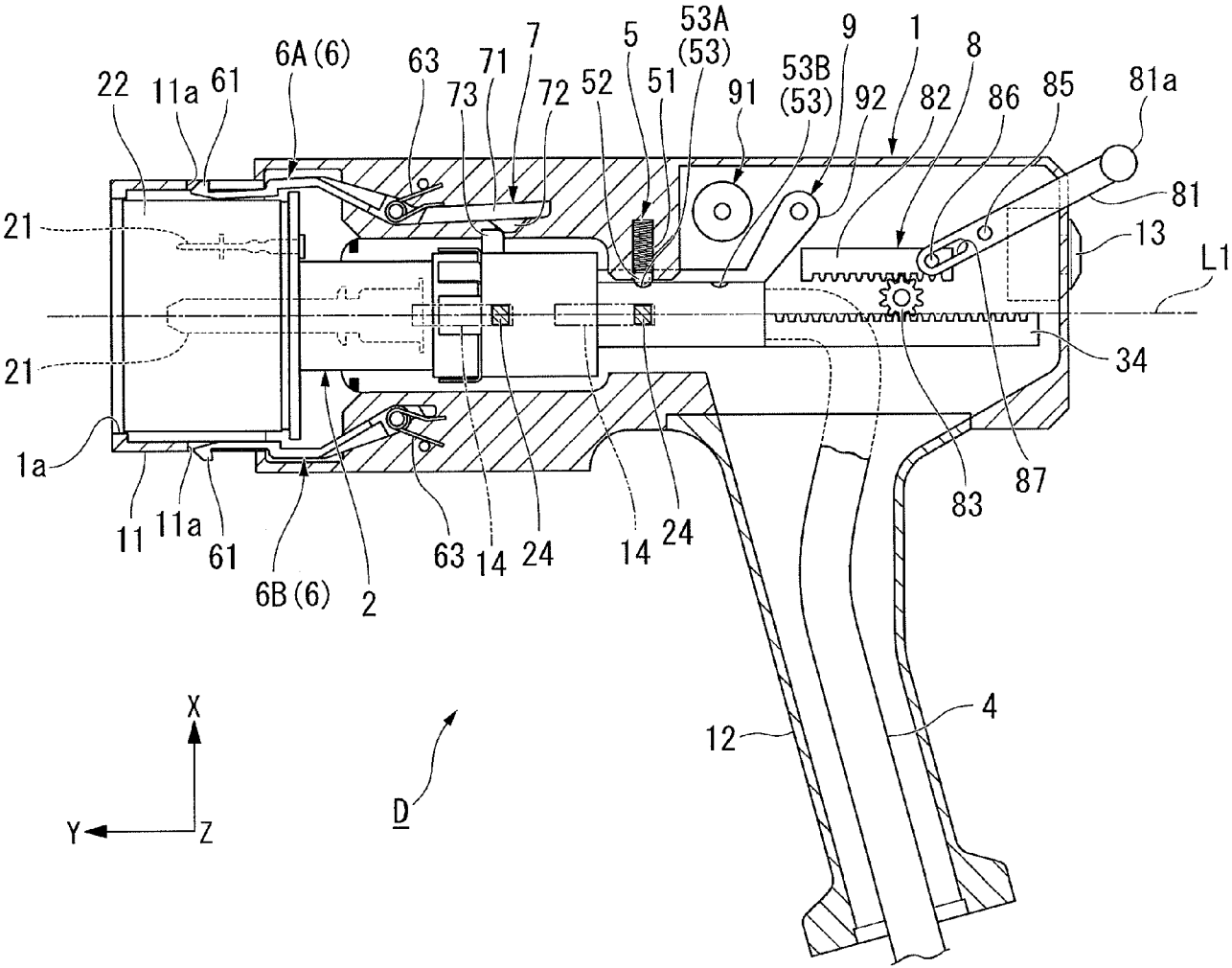
FIG. 6 is a cross-sectional view showing a power-feed connector according to a third embodiment of the present invention.
Figure 7:
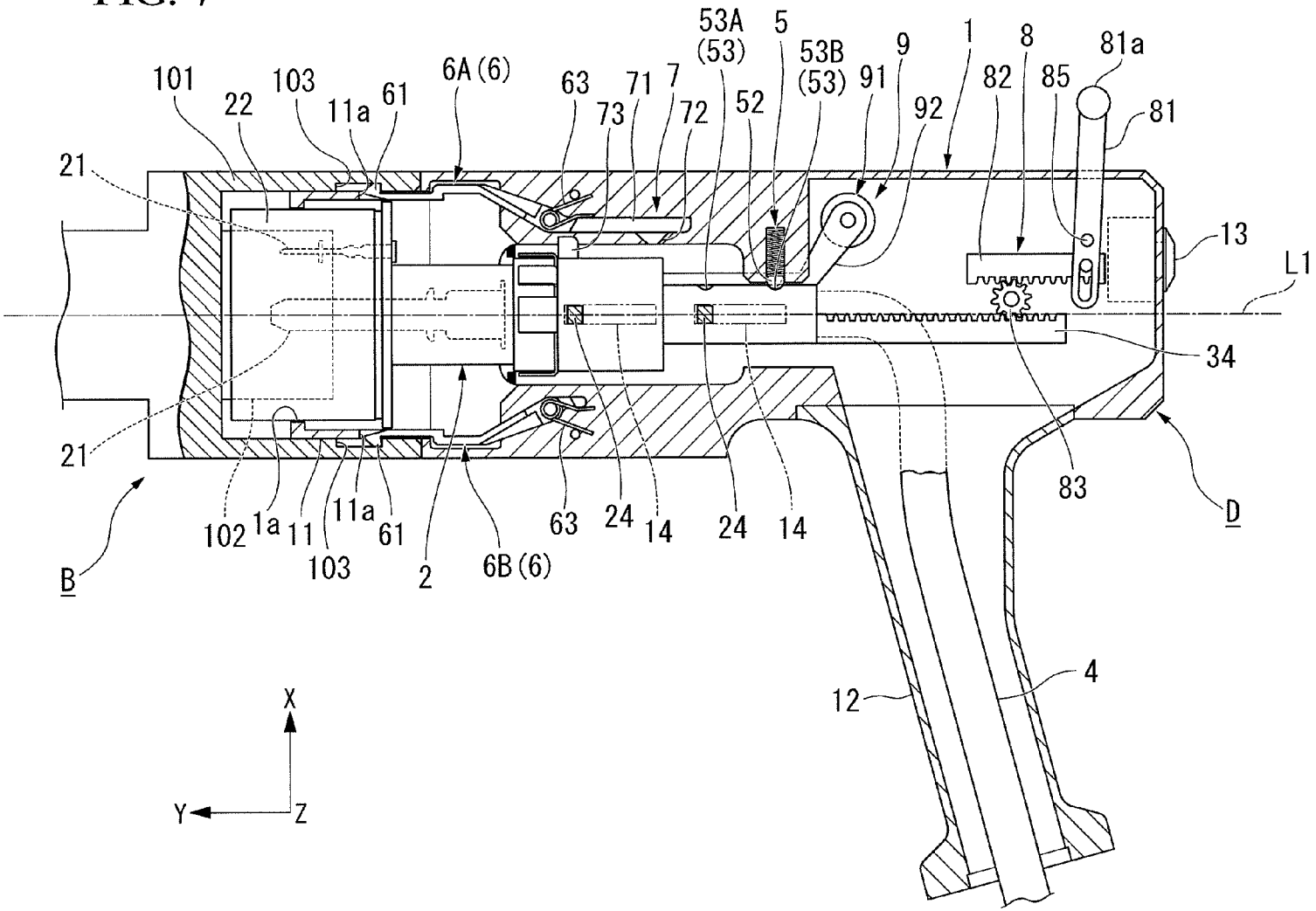
FIG. 7 is a cross-sectional view showing a state in which the power-feed connector shown in FIG. 6 connects to the power-receiving connector.

FIG. 6 and FIG. 7 are horizontal cross-sectional views showing a power-feed connector D of the third embodiment. FIG. 6 shows a state in which the connector body 2 is positioned in the storage position. FIG. 7 shows a state in which the connector body 2 is positioned in the protruding position protruding from the front end opening portion 1*a*.

As shown in FIG. 6, the power-feed connector D of the present embodiment connects to the power-receiving connector B shown in FIG. 2 same as in the above-described embodiment. The operating mechanism 8 making up the power-feed connector D includes the same rack 34 as that in the second embodiment, an operating lever 81 pivotally supported such that it can rotate with respect to the tubular case 1, a subsidiary rack 82 which slides along the center axis L1 direction, and a spur gear 83 pivotally supported at the tubular case 1.

The first end 81*a* of the operating lever 81 in the longitudinal direction protrudes outside the tubular case 1. In the midway portion of the operating lever 81 in the longitudinal direction, the operating lever 81 is pivotally supported at the tubular case 1 through a lever axis 85 which is perpendicular to the center axis L1 direction. Thereby, the operating lever 81 can rotate within a fictive plane (X-Y plane) extending along the center axis L1 direction same as in the second embodiment.

The lever axis 85 is placed upper side (+X direction side) of the forming face of the dents of the rack 34. The first end 81*a* of the operating lever 81 is placed further upper side of the forming face of the dents of the rack 34 than the lever axis 85. In the other words, the first end 81*a* of the operating lever 81 is placed at the forming face side of the dents of the rack 34.

The subsidiary rack 82 is positioned on the upper side of the forming face of the dents of the rack 34, and the dents of the subsidiary rack 82 face the dents of the rack 34.

The shaft portion 86 protrudes and is formed at the lateral portion of the subsidiary rack 82, and is inserted into a long hole 87 formed at the second end of the operating lever 81. The long hole 87 is formed such that it extends along the longitudinal direction of the operating lever 81. The shaft portion 86 of the subsidiary rack 82 is movable along the longitudinal direction within the long hole 87. According to this configuration, the rotation movement of the operating lever 81 can be converted into the linear movement of the subsidiary rack 82. In other word, the subsidiary rack 82 can slide along the center axis L1 direction in association with the rotation of the operating lever 81. The moving direction of the first end 81*a* of the operating lever 81 is opposite to the sliding direction of the subsidiary rack 82.

The spur gear 83 is placed between the rack 34 and the subsidiary rack 82, and engages with both of the rack 34 and the subsidiary rack 82. Thereby, the spur gear 83 rotates in association with the sliding of the subsidiary rack 82 along the center axis L1 direction.

In the operating mechanism 8 having above-described configuration, since the rack 34 and the subsidiary rack 82 move inversely, the moving direction of the first end 81*a* of the operating lever 81 coincides with the moving direction of the connector body 2 which moves in association with the rotation of the operating lever 81. A conversion mechanism converting the rotating force of the operating lever 81 only into a force in the center axis direction of the tubular case is made up of the rack 34, the subsidiary rack 82, and the spur gear 83.

When connecting the power-feed connector D of the present embodiment to the power-receiving connector B, same as in the second embodiment, the front end portion of the power-feed connector D is plugged into the power-receiving connector B. Then an operator grips the first end 81*a* of the operating lever 81, and rotates the operating lever 81 such that the first end 81*a* moves to the front end side of the tubular case 1. Thereby, the connector body 2 moves from the storage position shown in FIG. 6 to the protruding position shown in FIG. 7.

When detaching the power-feed connector D from the power-receiving connector B, same as in the second embodiment, an operator grips the first end 81*a* of the operating lever 81 and rotates the operating lever 81 such that the first end 81*a* moves to the rear end side of the tubular case 1. Thereby, the connector body 2 moves from the protruding position to the storage position.

Therefore, according to the power-feed connector D of the present embodiment, the effects same as in the first and the second embodiment can be achieved.

The power-feed connectors of the embodiments of the present invention have been described. However, the present invention is not limited to the above-described embodiments; variant modifications can be made without departing from the scope of the present invention.

For example, in the operating mechanism 3 of the second embodiment, two of the first and the second spur gear 32, 33 are positioned between the operating lever 31 and the rack 34. However, it is not limited to this, it is only necessary to set even numbers of the spur gear. According to this, the moving direction of the first end 31*a* of the operating lever 31 can coincide with the moving direction of the connector body 2 which moves in association with the rotation of the operating lever 31.

The first end 31*a* of the operating lever 31 of the operating mechanism 3 of the second embodiment is placed at the forming face side of the dents of the rack 34 same as the spur gear 32,33. However, for example, the first end 31*a* of the operating lever 31 can be placed at an opposite side of the forming face of the dents of the rack 34. For example in FIG. 4, the operating lever 31 can protrude to the same direction as, for example, the grip 12. In this configuration, by setting odd numbers of the spur gears between the operating lever 31 and the rack 34, the moving direction of the first end 31*a* of the operating lever 31 can coincide with the moving direction of the connector body 2 which moves in association with the rotation of the operating lever 31.

Furthermore, in the embodiments, the operating mechanism 3, 8 is made up of the gear mechanism using the spur gear 32, 33, 83, the rack 34, and the like. However, it is not limited to this, it is only necessary to keep the moving direction of the first end 31*a*, 81*a* of the operating lever 31, 81 coincides with the moving direction of the connector body 2 which moves in association with the rotation of the operating lever 31, 81. Namely, the operating mechanism 3, 8 may be made up of any mechanism which can convert the rotation movement of the operating lever 31, 81 into the linear movement of the connector body 2.

In the embodiments, the regulating member 5 for regulating the moving range of the connector body 2 is made up of the ball plunger 52 formed at the tubular case 1 side and the concave portion 53 formed at the connector body 2. However, it is not limited to this, for example, the regulating member 5 can be made up of the sliding groove 14 of the tubular case 1 for housing the sliding pin 24 of the connector body 2, or for example, can be formed so as to regulate the rotating angle range of the operating lever 31, 81.

In the embodiments, the power-feed connectors A, C, D provided for the charging apparatus for the electric vehicle is described. However, the power-feed connector of the embodiments of the present invention can also be applied to a charging apparatus for various electric machines which are driven by electric power.

Fourth Embodiment

Herein after, the power-feed connector of a fourth embodiment of the present invention will be described with reference to FIG. 8 and FIG. 9. Here, only the difference with the first to the third embodiments will be described, and the same parts as those of the power-feed connectors A, C and D are denoted by the same reference numerals, and thus a detailed description thereof will be simplified or omitted.

The power-feed connector E of the present embodiment includes a plurality of (two in the FIG.) locking arms (locking member) 6 which is provided at the front end side of the tubular case 1 and which locks the power-feed connector E to the power-receiving connector B. The plurality of locking arms 6 are arranged in the circumferential direction of the tubular case 1 such that they encircle the connector body 2.

Each locking arm 6 is formed in a near rod shape extending along the center axis L1 direction. A locking claw 61 protruding outside along the radial direction of the tubular case 1 is formed at the front end (one end) of the locking arm 6, and the rear end (the other end) of the locking arm 6 is pivotally supported at the tubular case 1 through the pin 62. Namely, each locking arm 6 is mounted such that it can oscillate with respect to the tubular case 1.

Furthermore, the torsion spring (urging member) 63 is fixed at the pin 62, by the urging force of the torsion spring 63, the locking arm 6 is urged to an oscillation direction (one oscillation direction) such that the front end side of the locking arm 6 moves outside along the radial direction of the tubular case 1. In this urging state, the locking claw 61 protrudes to the outside from the insertion hole 11*a* of the tubular case 1.

Furthermore, the power-feed connector E of the present embodiment includes an unlocking mechanism 7. The unlocking mechanism 7 is operated simultaneously with the movement of the connector body 2 from the protruding position to the storage position by operating the operating lever 31, thus resisting the urging force of the torsion spring 63, and retracting the locking claw 61 of the first locking arm (locking member) 6A into the tubular case 1. The unlocking mechanism 7 includes an extension portion 71 extending from the rear end of the first locking arm 6A along the center axis L1 to the rear end side (−Y direction) of the tubular case 1, a first projecting portion 72 formed at the extension portion 71, and a second projecting portion 73 formed at the outer periphery of the connector body 2.

The extension portion 71 faces the outer periphery of the cable storage portion 23, the first projecting portion 72 protrudes toward the outer periphery of the cable storage portion 23. The protruding height of the first projecting portion 72 is set so as to not contact with the outer periphery of the cable storage portion 23.

The second projecting portion 73 protrudes toward the extension portion 71, and in a state in which the connector body 2 is placed at the protruding position (see FIG. 9), the second projecting portion 73 does not make contact with the first projecting portion 72 or the extension portion 71. On the other hand, in a state in which the connector body 2 is placed at the storage position (see FIG. 8), the second projecting portion 73 makes contact with the first projecting portion 72.

According to this contact, the second projecting portion 73 resists the urging force of the torsion spring 63, and presses the extension portion 71 to the outside along the radial direction of the tubular case. As a result, the locking claw 61 of the first locking arm 6A is retracted into the tubular case 1.

Namely, the unlocking mechanism 7 and the above-described torsion spring 63 constitute an interlocking moving mechanism 10. The interlocking moving mechanism 10 operates simultaneously with the movement of the connector body 2 between the storage position and the protruding position by operating the operating lever 31, and makes the locking claw 61 of the first locking arm 6A move between a retracted position (a position shown in FIG. 8) within the tubular case 1 and a locking position (a position shown in FIG. 9) protruding outside from the insertion hole 11*a* and locking to the power-receiving connector B.

The power-feed connector E of the present embodiment includes an electromagnetic locking mechanism 9 which prevent the movement of the connector body 2 with respect to the tubular case 1 during charging. The electromagnetic locking mechanism 9 includes a solenoid 91 and a locking portion 92. The solenoid 91 includes a tubular electromagnet 93 fixed at the tubular case 1 and a plunger 94 which is inserted into the tubular electromagnet 93. The locking portion 92 has an engaging hole 92*a* which is provided at the connector body 2 and into which the plunger 94 is inserted. As shown in the FIGs, the locking portion 92 is placed at the connector body 2 as a separate member. However, it is not limited to this; for example, the locking portion 92 can be formed integrally with the connector body 2.

The plunger 94 of the solenoid 91 is housed in the electromagnet 93 by an urging member (not shown) or the like, in a state in which the electrical current does not flow in the electromagnet 93. The plunger 94 protrudes from the electromagnet 93 in a state in which the electrical current flows in the electromagnet 93. The electric power is supplied to the electromagnet 93 while charging (when supply the electric power to the electric vehicle).

In a state in which the connector body 2 is positioned in the protruding position, the locking portion 92 is positioned (insertion position) such that the plunger 94 protrudes from the electromagnet 93 can be inserted into the engaging hole 92*a*. In a state in which the connector body 2 is positioned in the storage position, the engaging hole 92*a* of the locking portion 92 is positioned off the plunger 94, and the plunger 94 does not insert into the engaging hole 92*a*, even if the plunger 94 protrudes.

The power-receiving connector B which connects to the power-feed connector E having above-described configuration is fixed at the vehicle body of the electric vehicle and the like. The power-receiving connector B includes a tubular shell 101 which accommodates the insertion portion 11 of the tubular case 1, a tubular terminal storage portion 102 which is provided at an inner portion of the tubular shell 101, and a power-receiving side terminal (not shown) provided in the terminal storage portion 102. In a state in which the insertion portion 11 of the tubular case 1 is accommodated within the shell 101 (see FIG. 9), the terminal storage portion 102 is accommodated within the terminal storage portion 22 of the connector body 2. Namely, the shapes of the shell 101 and the terminal storage portion 102 correspond to the shape of the insertion portion 11 and the terminal storage portion 22 of the power-feed connector respectively. A locking concave portion 103 is formed at the inner periphery of the shell 101, in which the locking concave portion 103 engages with the locking claw 61 of the power-feed connector E. The number and the arrangement of the locking concave portions 103 correspond to the number and the arrangement of the locking arms 6.

The power-feed connector E and the power-receiving connector B are electrically connected by making contact with or connecting to (abutting against) the power-receiving side terminal to the power-feed side terminal 21 of the power-feed connector E. The power-receiving side terminal has the same function as the power-feed side terminal 21. Namely, the number and arrangement of the power-receiving side terminal correspond to that of the power-feed side terminal 21 of the power-feed connector E.

Figure 8:
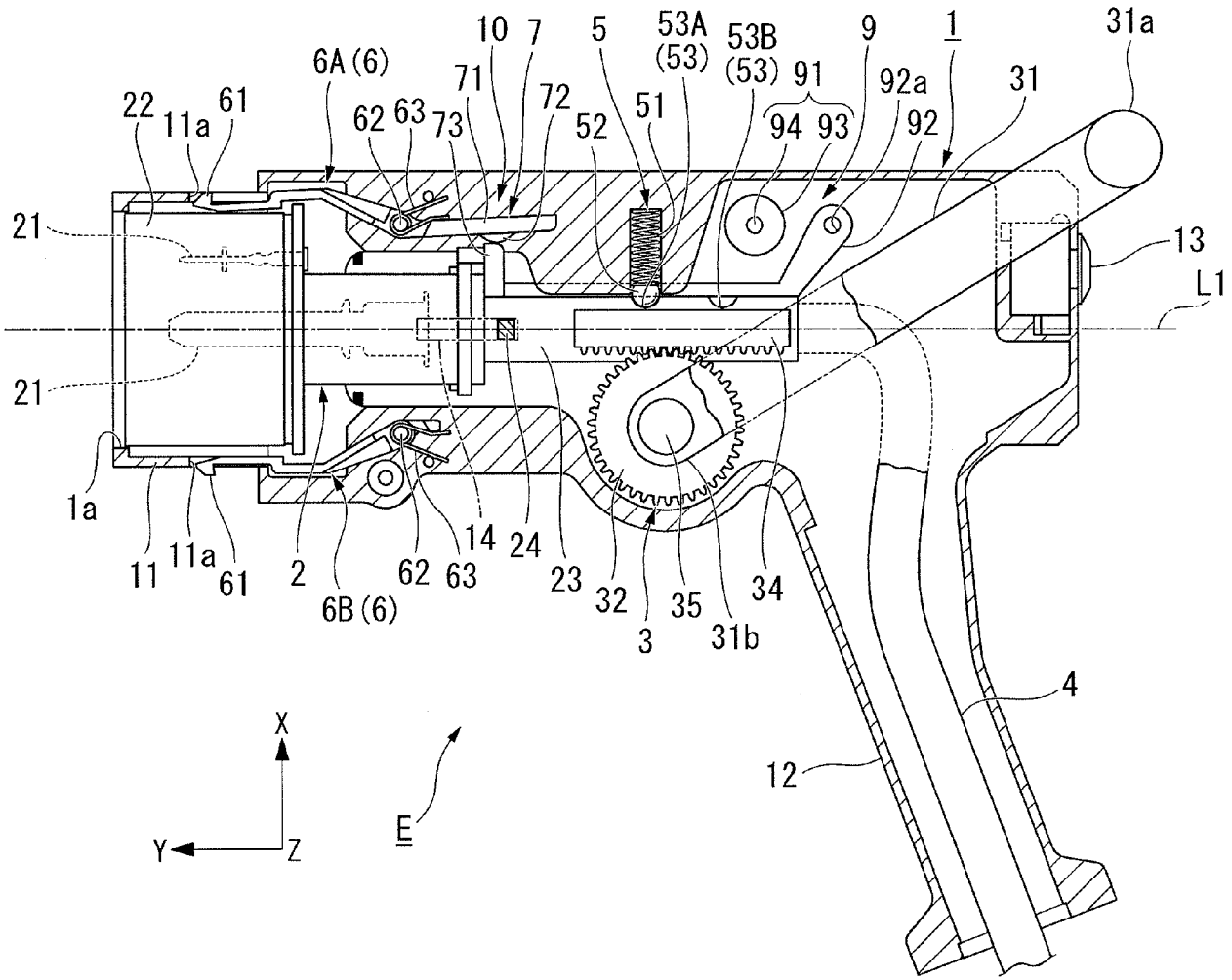
FIG. 8 is a cross-sectional view of a power-feed connector according to a fourth embodiment of the present invention.
Figure 9:
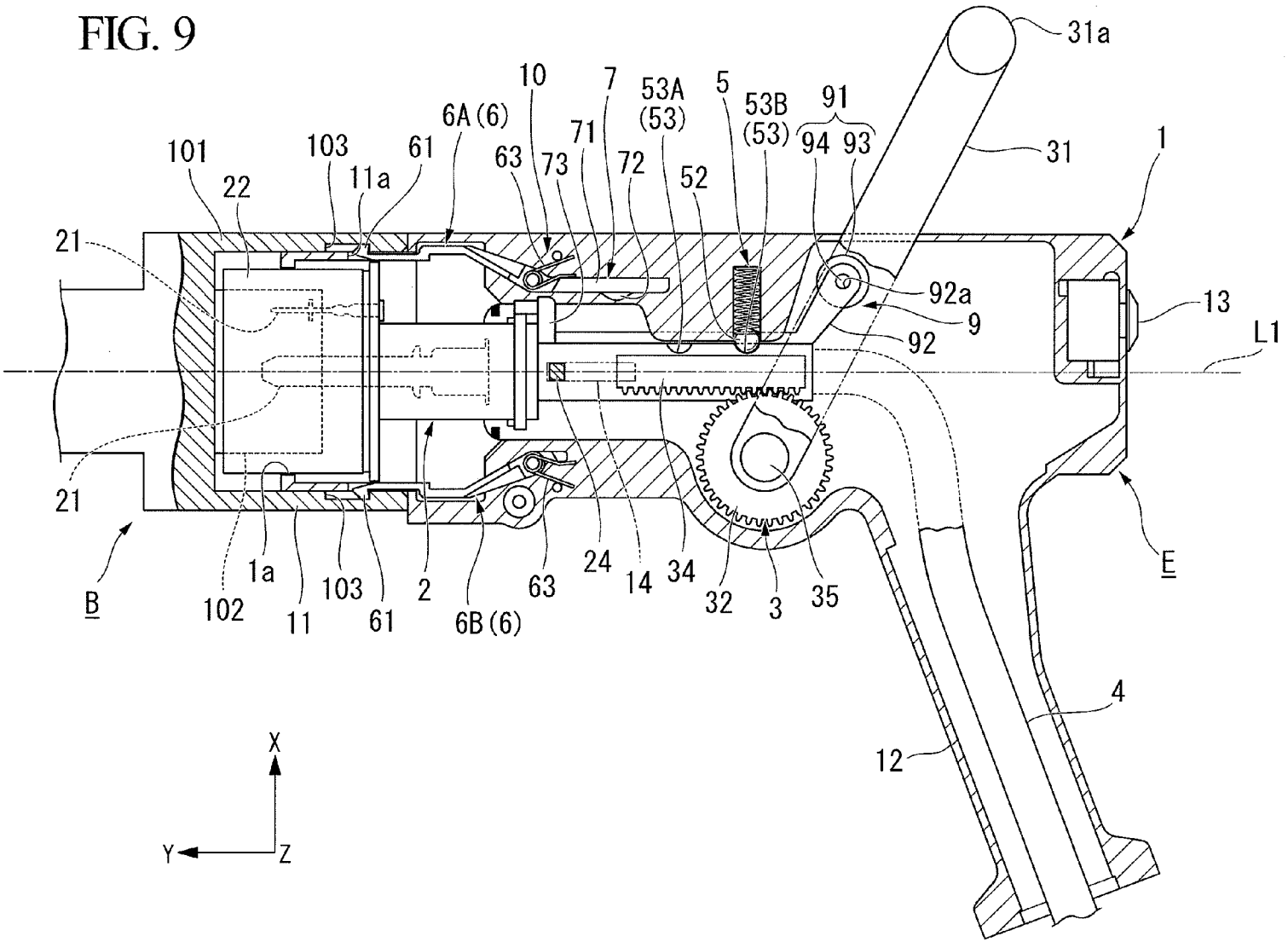
FIG. 9 is a cross-sectional view showing a state in which the power-feed connector shown in FIG. 8 connects to the power-receiving connector.

When connecting the power-feed connector E which has the above-described configuration to the power-receiving connector B, as shown in FIG. 8, in a state in which the connector body 2 is placed in the storage position, the operator grips the grip 12 and inserts the front end portion (insertion portion 11) of the tubular case 1 into the shell 101, such that the power-feed connector E is plugged into the power-receiving connector B. In this state, as shown in FIG. 9, the locking claw 61 of the second locking arm 6B engages with the locking concave portion 103 of the power-receiving connector B, so that it adopts a state in which the power-feed connector E preliminarily engages with the power-receiving connector B.

Then, the connector body 2 is moved to the front end side of the tubular case 1 through the operating mechanism 3, such that the connector body 2 is placed at the protruding position. Specifically, the connector body 2 is moved to the front end side of the tubular case 1 and is placed at the protruding position, by gripping the first end 31*a* of the operating lever 31 and rotating the operating lever 31 such that the first end 31*a* of the operating lever 31 moves to the front end side of the tubular case 1 by an operator.

In this state, the second protruding portion 73 of the unlocking mechanism 7 moves together with the connector body 2 and moves away from the first protruding portion 72 by operating the operating lever 31. Therefore, the locking claw 61 of the first locking arm 6A protrudes outside from the insertion hole 11*a* of the tubular case 1, and engages with the locking concave portion 103 of the power-receiving connector B, through the urging force of the torsion spring 63. Hereby, the tubular case 1 is locked to the shell 101 by the first locking arm 6A, and the power-feed connector E fully engages with the power-receiving connector B. In this state, the power-feed side terminal 21 makes contact with or connects to (abuts against) the power-receiving side terminal, and the power-feed connector E electrically connects to the power-receiving connector B, so that it becomes a chargeable state.

While rotating the operating lever 31, the locking claw 61 of the first locking arm 6A engages with the locking concave portion 103 of the power-receiving connector B, and then the power-feed connector E electrically connects to the power-receiving connector B.

When the charging is started in this fully engaged state, the electrical current flows in the electromagnet 93, and the plunger 94 is inserted into the engaging hole 92*a* of the locking portion 92. Namely, the electromagnetic locking mechanism 9 prevents the connector body 2 from moving, and can reliably prevent the power-feed side terminal 21 of the power-feed connector E from pulling off the power-receiving side terminal of the power-receiving connector B during charging.

When the charging has completed, the supply of the electric power to the electromagnet 93 is stopped, and the plunger 94 is released from the engaging hole 92*a* of the locking portion 92. Namely, the connector body 2 can move.

Then, when detaching the power-feed connector E from the power-receiving connector B from a state in which the power-feed connector E is fully engaged with the power-receiving connector B, at first, an operator grips the first end 31*a* of the operating lever 31 and rotates the operating lever 31 so that the first end 31*a* of the operating lever 31 moves to the rear end side of the tubular case 1. Hereby, the connector body 2 moves to the rear end side of the tubular case 1, and is positioned at the storage position.

In this stage, the second protruding portion 73 of the unlocking mechanism 7 moves together with the connector body 2 and makes contact with (abuts against) to the first protruding portion 72 by operating the operating lever 31. Hereby, the second protruding portion 73 resists the urging force of the torsion spring 63 and presses the extension portion 71 to the outside along the radial direction of the tubular case 1, and the locking claw 61 of the first locking arm 6A retracts into the tubular case 1. Namely, the locking state between the tubular case 1 and the shell 101 through the first locking arm 6A is released, and returns to the state in which the power-feed connector E is preliminarily engaged with the power-receiving connector B.

Then, a detachment operation of the power-feed connector E completed by gripping the grip 12 and pulling out the power-feed connector E from the power-receiving connector B.

In the preliminary engaging state, even though the locking claw 61 of the second locking arm 6B engages with the power-receiving connector B, the engagement of the locking claw 61 of the first locking arm 6A with the power-receiving connector B is released. Therefore, the power-feed connector E easily pulled out since the engaging force between the power-feed connector E and the power-receiving connector B is impaired.

As described above, according to the power-feed connector E of the present embodiment, the connecting operation and the detaching operation between the power-feed connector E and the power-receiving connector B can be performed only by operating one operating lever 31, the operation performance of the power-feed connector E improved, and the charging operation can be performed smoothly.

In addition, since the movement of the connector body 2 and the first locking arm 6A is performed only by the operating mechanism 3 and the interlocking moving mechanism 10, the inner structure of the power-feed connector E can be simplified, and miniaturization or the cost of manufacturing can be reduced.

Furthermore, since the mechanism for positioning the first locking arm 6A of the interlocking moving mechanism 10 to the locking position is only made up of a simple torsion spring, the inner structure of the power-feed connector E can be further simplified.

In addition, the unlocking mechanism 7 for positioning the first locking arm 6A of the interlocking moving mechanism 10 to the retracted position is only made up of the extension portion 71 formed at the first locking arm 6A, the first projecting portion 72, and the second projecting portion 73 formed at the connector body 2. Therefore, the component parts of the interlocking moving mechanism 10 housed in the tubular case 1 are not increased. Therefore, the inner structure of the power-feed connector E can be further simplified.

The power-feed connector of the embodiments of the present invention have been described. However, the present invention is not limited to the above-described embodiment; variant modifications can be made without departing from the scope of the present invention.

For example, the unlocking mechanism 7 having the extension portion 71 and the second projecting portion 73 is only necessary to be configured such that at least in a state in which when the connector body 2 is positioned at the storage position, the second projecting portion 73 makes contact with the extension portion 71 and places the locking claw 61 to the retracted position; and in a state in which the connector body 2 is positioned at the protruding position, the second projecting portion 73 moves away from the extension portion 71, and the locking claw 61 is placed to the locking position through the urging force of the torsion spring 63. Therefore, the first projecting portion 72 may not formed in the extension portion 71 as in the above-described embodiment.

Furthermore, the unlocking mechanism 7 is not limited to the configuration made up of the extension portion 71 and the second projecting portion 73. The unlocking mechanism 7 only necessary to be configured that at least the unlocking mechanism 7 operates simultaneously with the movement of the connector body 2 from the protruding position to the storage position by operating the operating mechanism 3, such that the unlocking mechanism 7 resists the urging force of the torsion spring 63 and moves the locking claw 61 from the locking position to the retracted position.

Furthermore, the urging member for urging the locking claw 61 to the locking position is not limited to the torsion spring 63, which urges the locking arm 6 to one oscillation direction. For example, the urging member may be a coil spring that urges the front end side of the locking arm 6 to the outside along the radial direction of the tubular case 1, or that urges the extension portion 71 formed integrally with the first locking arm 6A to the inside along the radial direction of the tubular case 1.

Furthermore, the interlocking moving mechanism 10 is not limited to the configuration made up of the urging member such as the torsion spring 63, and the unlocking mechanism 7. For example, the interlocking moving mechanism 10 may be made up of a link mechanism that links the connector body 2 and the first locking arm 6A, or a gear mechanism that converts the oscillating movement of the first locking arm 6A into the linear movement of the connector body 2.

Furthermore, in the above-described embodiment, the locking member for locking the tubular case 1 with power-receiving connector B is made up of the locking arm 6 pivotally supported at the tubular case 1. However, it is only necessary to provide at the tubular case 1 such that the locking claw 61 of the locking member can move between the locking position and the retracted position, or, for example, it is only necessary to provide at the tubular case 1 such that the entire locking member can parallely move along the radial direction of the tubular case 1.

In the above embodiment, the operating mechanism 3 is made up of the gear mechanism having the spur gear 32 and the rack 34. However, for example, the operating mechanism 3 can be made up of any mechanism used a link or a cam. The operating mechanism 3 is only necessary to be configured that can move the connector body 2 between the storage position and the protruding position at least, and the moving direction of the first end 31*a* of the operating lever 31 is not necessary to coincide with the moving direction of the connector body 2 as in the above embodiment.

Furthermore, in the above embodiment, the regulating member 5 for regulating the moving range of the connector body 2 is made up of the ball plunger 52 formed at the tubular case 1 side and the concave portion 53 formed at the connector body 2. However, it is not limited to this, for example, the regulating member 5 may be made up of the sliding groove 14 of the tubular case 1 for housing the sliding pin 24 of the connector body 2, or, for example, may be a configuration such that the rotating angle range of the operating lever 31 is regulated.

In the above-described embodiment, the power-feed connector provided for the charging apparatus for the electric vehicle is described. However, the power-feed connectors of the present invention can also be applied to a charging apparatus for various electric machines which are driven by electric power.

While connecting the power-feed connector of the embodiment of the present invention to the power-receiving connector, for example, the front end opening portion of the tubular case is plugged into the power-receiving connector, and the tubular case is attached to the power-receiving connector. After that, by moving the connector body to the protruding position from the storage position by operating the operating mechanism, the terminals of the power-feed connector are electrically connected to the terminals of the power-receiving connector.

On this occasion, since the locking member moves to the locking position from the retracted position simultaneously with the movement of the connector body through the operating mechanism, the tubular case can be locked to the power-receiving connector.

While detaching the power-feed connector from the power-receiving connector, by moving the connector body to the storage position from the protruding position by operating the operating mechanism, the electrical connection between the power-feed connector and the power-receiving connector is broken.

On this occasion, since the locking member moves to the retracted position from the locking position simultaneously with the movement of the connector body through the operating mechanism, the locking state between the tubular case and the power-receiving connector is released.

Therefore, according to the power-feed connector, the connecting operation and the detaching operation between the power-feed connector and the power-receiving connector can be performed only by operating the same operating mechanism, thus the charging operation can be performed smoothly.

In addition, since the movements of the connector body and the locking member are only performed by the operating mechanism and the interlocking moving mechanism, the inner structure of the power-feed connector can be simplified, and the miniaturization or the cost of manufacturing can be reduced.

According to the power-feed connector of the present invention, the power-feed connector can easily attach to and can easily detach from the power-receiving connector by operating one lever.

What is claimed is:

1. A power-feed connector, comprising:

a tubular case that has a front end opening portion;

a connector body that is housed in the tubular case, and that can slide along a center axis direction of the tubular case; and an operating mechanism that operates the sliding of the connector body along the center axis direction, wherein the operating mechanism at least comprises an operating lever that is pivotally supported at the tubular case rotatably and a first end of which protrudes outside the tubular case, and a conversion mechanism that converts a rotating force of the operating lever generated by moving the first end only into a force in the center axis direction of the tubular case;

the conversion mechanism comprises a spur gear that is pivotally supported at the tubular case integrally with a second end of the operating lever, and a rack that is fixed at the connector body and moves along the center axis direction of the tubular case simultaneously with a rotation of the spur gear;

a moving direction of the first end of the operating lever is coincident with a moving direction of the connector body which moves in association with the rotation of the operating lever; and an action point that applies the rotating force of the operating lever to the connector body is positioned between the first end and the second end of the operating lever.

2. The power-feed connector according to claim 1, further comprising an electromagnetic locking mechanism having a solenoid provided at the tubular case, and a locking portion provided at the connector body.

3. The power-feed connector according to claim 2, wherein the solenoid comprises a tubular electromagnet fixed at the tubular case, and a plunger inserted into the tubular electromagnet; and the locking portion comprises an engaging hole into which the plunger can be inserted.

4. The power-feed connector according to claim 1, further comprising:

a locking member at least a first end of which is pivotally supported at the tubular case rotatably; and an interlocking moving mechanism that oscillates the first end of the locking member simultaneously with the movement of the connector body in the center axis direction of the tubular case.

5. The power-feed connector according to claim 4, wherein the interlocking moving mechanism comprises:

an urging member that applies an urging force to the locking member; and an unlocking mechanism that applies an unlocking force which resists the urging force of the urging member to the locking member simultaneously with the movement of the connector body in the center axis direction of the tubular case.

6. The power-feed connector according to claim 5, wherein a locking claw is formed at the first end of the locking member; and the unlocking mechanism comprises an extension portion that is formed at the second end of the locking member and is extended along the center axis direction of the tubular case, a first projecting portion that is provided at the extension portion and protrudes to an outer periphery side of the connector body, and a second projecting portion that is provided at the outer periphery of the connector body and protrudes to the first projecting portion side.

7. The power-feed connector according to claim 1, further comprising:

a regulating member that is provided in an inner portion of the tubular case, and regulates the movement of the connector body in the center axis direction of the tubular case.

8. The power-feed connector according to claim 7, wherein the regulating member comprises a ball plunger that is provided at the tubular case, an elastic body that applies an urging force to the ball plunger from the tubular case to the connector body, and a concave portion that is formed at an outer periphery of the connector body and supports a part of the ball plunger.

9. The power-feed connector according to any one of claims 1 and 2 to 8, further comprises a grip that is fixed at the tubular case, wherein the grip and the operating lever protrude in an opposite direction with respect to the tubular case.

* * * * *